US005809362A

United States Patent [19]

Tsuji

[11] Patent Number: 5,809,362

[45] Date of Patent: Sep. 15, 1998

[54] PHOTOSENSITIVE MATERIAL PROCESSING DEVICE

[75] Inventor: Osami Tsuji, Kanagawa, Japan

[73] Assignee: Fuji Photo Film Co., Ltd., Kanagawa, Japan

[21] Appl. No.: 792,197

[22] Filed: Jan. 30, 1997

[30] Foreign Application Priority Data

Jan. 31, 1996 [JP] Japan ..... 8-016177

[51] Int. Cl.[6] ..... G03D 3/02; G03D 3/13

[52] U.S. Cl. ..... 396/576; 396/571; 396/620; 396/626; 396/636

[58] Field of Search ..... 396/571, 573, 396/576, 577, 617, 620, 622, 624, 626, 636

[56] References Cited

U.S. PATENT DOCUMENTS

| | | | |
|---|---|---|---|
| 4,466,722 | 8/1984 | Stande | 396/576 |
| 5,309,191 | 5/1994 | Bartell et al. | 396/576 |
| 5,486,890 | 1/1996 | Mogi | 396/571 |
| 5,619,743 | 4/1997 | Mogi et al. | 396/577 |

FOREIGN PATENT DOCUMENTS

| | | | |
|---|---|---|---|
| 62-246057 | 10/1987 | Japan | G03D 3/02 |
| 63-131138 | 6/1988 | Japan | G03D 5/26 |
| 4-83251 | 3/1992 | Japan | G03D 3/02 |
| 5-80479 | 4/1993 | Japan | G03D 3/00 |
| 5-204117 | 8/1993 | Japan | G03D 3/02 |

*Primary Examiner*—A. A. Mathews
*Attorney, Agent, or Firm*—Sughrue, Mion, Zinn, Macpeak & Seas, PLLC

[57] ABSTRACT

A photosensitive material processing device having a processing tank in which is stored a processing solution for processing photosensitive materials. The processing tank is formed such that, given that a tank volume is V milliliters and a path length is L centimeters, a value V/L is less than or equal to 25. A circulating path which circulates the processing solution within the processing tank is provided. A cast heater which heats the processing solution in the circulating path to a predetermined temperature is provided on the circulating path. Accordingly, because the processing tank is long and thin, stores a small amount of processing solution, and has a value V/L of less than or equal to 25, the cast heater heats the processing solution to the predetermined temperature in a short time and stably maintains the predetermined temperature. The photosensitive material processing device is advantageous in terms of cost and environmental preservation.

20 Claims, 18 Drawing Sheets

PHOTOSENSITIVE MATERIAL PROCESSING DEVICE

BACKGROUND OF THE INVENTION

1. Field of the Invention

The present invention relates to a photosensitive material processing device in which the temperature of a processing solution used for processing photosensitive materials and held within a processing tank, which holds a small amount of processing solution, is maintained constant. The present invention is well-suited for the developing processing of silver halide photographic photosensitive materials such as, for example, negative films.

2. Description of the Related Art

A negative film used for photography, which is a photosensitive material, must be subjected to developing processing after being photographed. To this end, the photographed negative film is sent into a processing device for developing negative films in which processing solutions such as developing solution, fixing solution, washing water and the like are stored in respective processing tanks. The negative film is successively immersed in developing solution, fixing solution, and washing water so as to be subjected to developing processing. In order to carry out reliable developing processing, a large amount of processing solution must be stored in each of the conventional processing tanks housed within the processing device. Further, because deterioration of the processing solution is promoted by oxidization and the like, in order to maintain high quality development of negative films, replenishing solution must be replenished into the processing solution so that the characteristics of the processing solution can always be maintained constant.

In order to stabilize the developing processing, the processing device includes subtanks which are usually separate from the processing tanks and in which heaters and temperature regulating devices are incorporated. Processing solution which is heated to a certain temperature in the subtank is circulated to the processing tank so that the processing solution within the processing tank can be maintained at a predetermined temperature. The replenishing solution is also supplied to the subtank to be heated to the given temperature.

However, in a processing device having the above-described structure, deterioration of the processing solution progresses even more as the processing solution is being circulated through the subtank and the processing tank. As a result, even in a case in which the amount of negative film processed per day is small, in order to maintain high quality development of the negative films, a large amount of processing solution must be stored, and accordingly, a large amount of replenishing solution is needed.

Because large amounts of processing solution and replenishing solution are needed, it is difficult to regulate the temperatures thereof at a low cost. Drawbacks arise in that the cost of operating the processing device increases and the environment deteriorates.

SUMMARY OF THE INVENTION

In view of the aforementioned, an object of the present invention is to provide a photosensitive material processing device in which the amounts of processing solutions in the processing tanks are decreased, and the temperatures of the processing solutions in the processing tanks which contain smaller amounts of processing solutions are maintained constant.

In accordance with one aspect of the present invention, there is provided a photosensitive material processing device having a processing tank in which is stored a processing solution for processing photosensitive materials, wherein the processing tank is formed such that, given that a tank volume of the processing tank is V milliliters and a path length which is a conveying distance from a position at which a photosensitive material begins to contact the processing solution within the processing tank to a position at which the photosensitive material is discharged from the processing solution is L centimeters, a value V/L is less than or equal to 25, and a circulating path which circulates the processing solution within the processing tank is provided, and a cast heater which heats the processing solution in the circulating path to a predetermined temperature is disposed on the circulating path.

The following effects are achieved by this photosensitive material processing device.

The tank volume of the processing tank in which the processing solution for processing photosensitive materials is stored is V milliliters. The path length, which is the conveying distance from the position at which the photosensitive material begins to contact the processing solution within the processing tank to the position at which the photosensitive material is discharged from the processing solution, is L centimeters. The processing tank is structured such that the value V/L is 25 or less.

A circulating path which circulates the processing solution within the processing tank is provided. A cast heater which heats the processing solution in the circulating path to a predetermined temperature is provided on the circulating path.

Accordingly, because the processing tank is long and thin and holds a small amount of processing solution and has a value V/L of 25 or less, the cast heater disposed on the circulating path can heat the processing solution to a predetermined temperature in a short time and can stably maintain the temperature of the processing solution at this predetermined temperature. The photosensitive material processing device is advantageous from the standpoints of cost and preservation of the environment.

For example, a heater in which a heat source and a piping for the solution to flow through are cast together in a metal block can be used as the cast heater.

In accordance with another aspect of the present invention, there is provided a photosensitive material processing device having a processing tank in which is stored a processing solution for processing photosensitive materials, wherein the processing tank is formed such that, given that a tank volume of the processing tank is V milliliters and a path length which is a conveying distance from a position at which a photosensitive material begins to contact the processing solution within the processing tank to a position at which the photosensitive material is discharged from the processing solution is L centimeters, a value V/L is less than or equal to 25, and a circulating path which circulates the processing solution within the processing tank and a replenishing path which replenishes replenishing solution to the processing tank are provided, and a cast heater, which heats the processing solution in the circulating path and the replenishing solution in the replenishing path to a predetermined temperature, is provided on the circulating path and on the replenishing path.

The following effects are achieved by this photosensitive material processing device.

In accordance with the present aspect, the same effects as those of the above-described first aspect are achieved.

Further, the circulating path which circulates the processing solution within the processing tank and the replenishing path which replenishes replenishing solution to the processing tank are provided. The cast heater which heats the processing solution in the circulating path and the replenishing solution in the replenishing path to a predetermined temperature is provided on the circulating path and the replenishing path. As a result, both the processing solution and the replenishing solution can be heated to a predetermined temperature, and the photosensitive material processing device is even more advantageous from the points of view of cost and environmental conservation.

In accordance with yet another aspect of the present invention, there is provided a photosensitive material processing device having a processing tank in which is stored a processing solution for processing photosensitive materials, wherein the processing tank is formed such that, given that a tank volume of the processing tank is V milliliters and a path length which is a conveying distance from a position at which a photosensitive material begins to contact the processing solution within the processing tank to a position at which the photosensitive material is discharged from the processing solution is L centimeters, a value V/L is less than or equal to 25, and a circulating path which circulates the processing solution within the processing tank is provided, and a cast heater which heats the processing solution in the circulating path to a predetermined temperature is mounted to the processing tank.

The following effects are achieved by this photosensitive material processing device.

In accordance with the present aspect, the same effects as those of the above-described first aspect are achieved. Further, the circulating path which circulates the processing solution in the processing tank is provided, and the cast heater which heats the processing solution in the circulating path to a predetermined temperature is mounted to the processing tank. As a result, the heat from the cast heater is transmitted efficiently, and accordingly, even more precise temperature management of the processing solution is possible.

Further, if the cast heater of the present aspect is mounted to the processing tank so as to be attachable thereto and removable therefrom, in a case in which there is trouble with the cast heater or the like, the cast heater can be replaced. Therefore, replacement can be carried out easily, and the trouble with the cast heater can be resolved at an early time.

DESCRIPTION OF THE PREFERRED EMBODIMENTS

Figure 1:
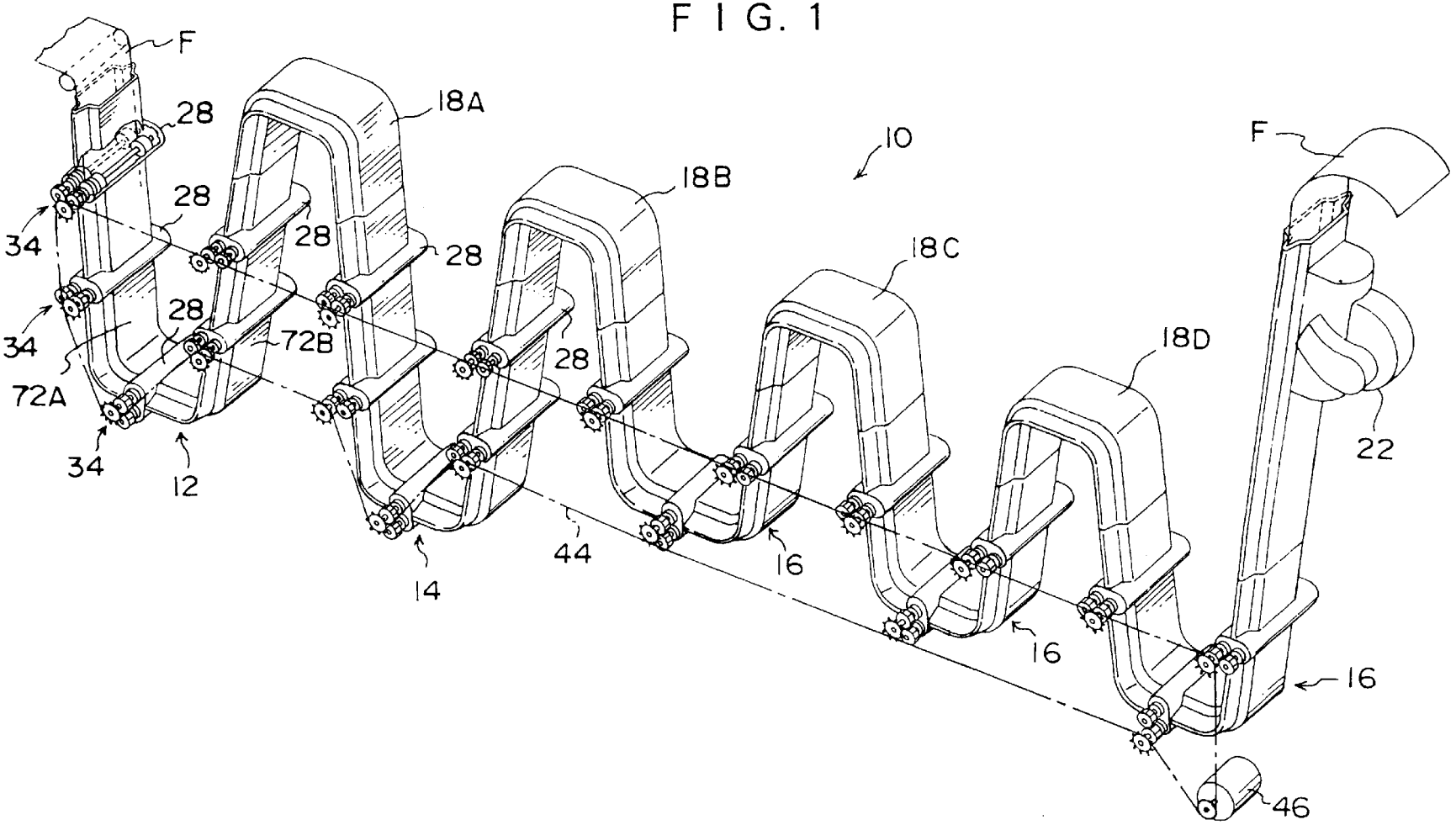
FIG. 1 is an overall schematic structural view of a photosensitive processing device relating to a first embodiment of the present invention.

A first embodiment of a photosensitive material processing device of the present invention is illustrated in the drawings, and will be described on the basis of the drawings.

As illustrated in FIG. 1, in a photosensitive material processing device 10 relating to the present first embodiment, a bleaching/fixing tank 14, which is formed from a crystalline resin and in a U-shape, is connected via a connecting member 18A to a developing tank 12, which is also formed from a crystalline resin and formed in a U-shape. Three stabilizing tanks 16, which are formed from crystalline resins and in U-shapes and are connected in a row by connecting members 18C, 18D, are connected to the bleaching/fixing tank 14 via a connecting member 18B. Developing solution is stored in the developing tank 12, bleaching/fixing solution is stored in the bleaching/fixing tank 14, and washing water is stored in each of the three stabilizing tanks 16.

Accordingly, when a negative film F which has been photographed is inserted from the open end side of the developing tank 12 of the photosensitive material processing device 10, the negative film F is immersed successively in the processing tanks which are the developing tank 12, the bleaching/fixing tank 14 and the three stabilizing tanks 16, so as to be subjected to developing processing.

A drying fan 22 is disposed at the open end of the last stabilizing tank 16. The negative film F which has exited from the stabilizing tanks 16 is inserted into and dried at the drying fan 22. A cover (not shown) is mounted to the photosensitive material processing device 10 so as to cover the processing tanks as a whole.

Figure 2:
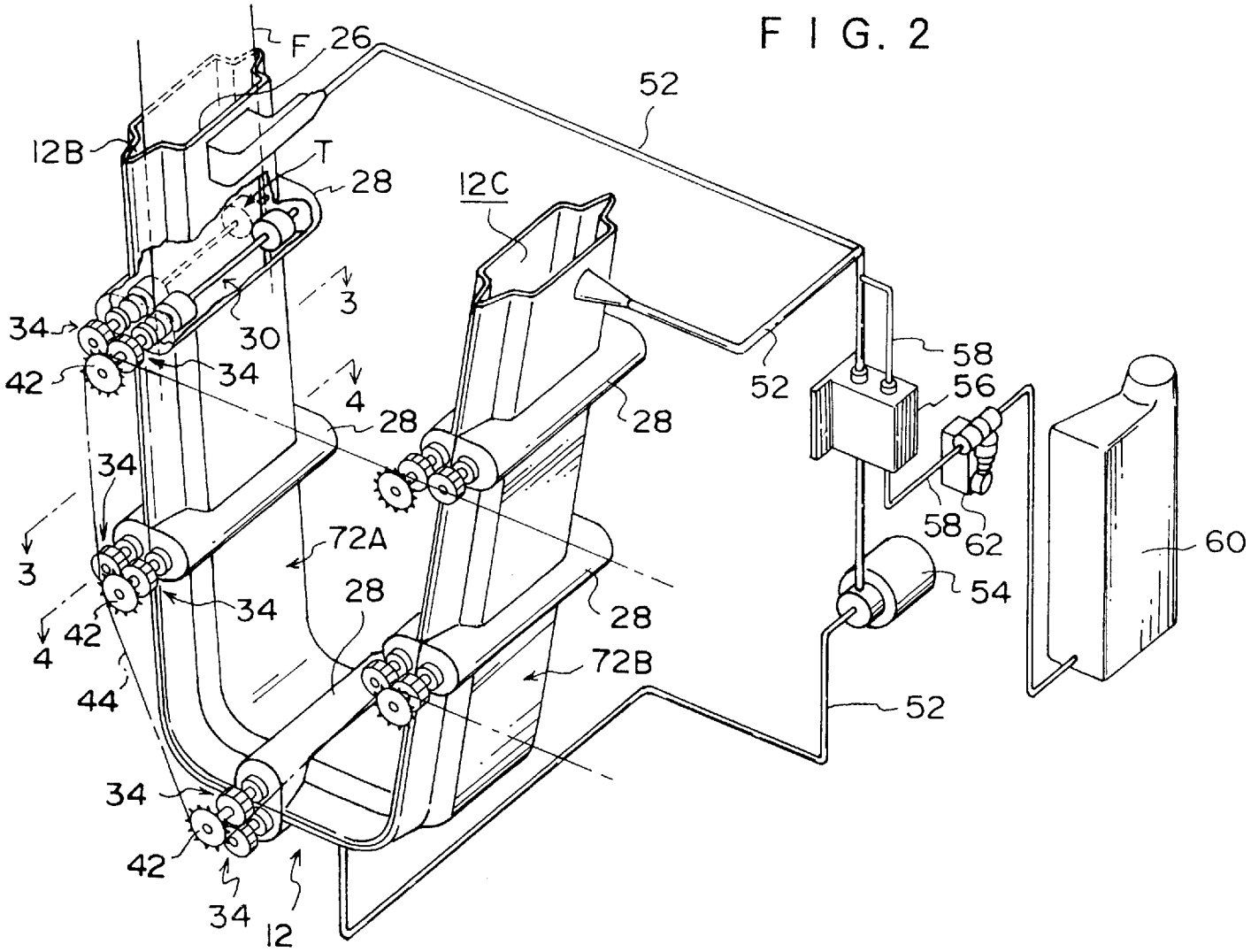
FIG. 2 is an enlarged schematic view of a periphery of a developing tank relating to the first embodiment of the present invention.
Figure 3:
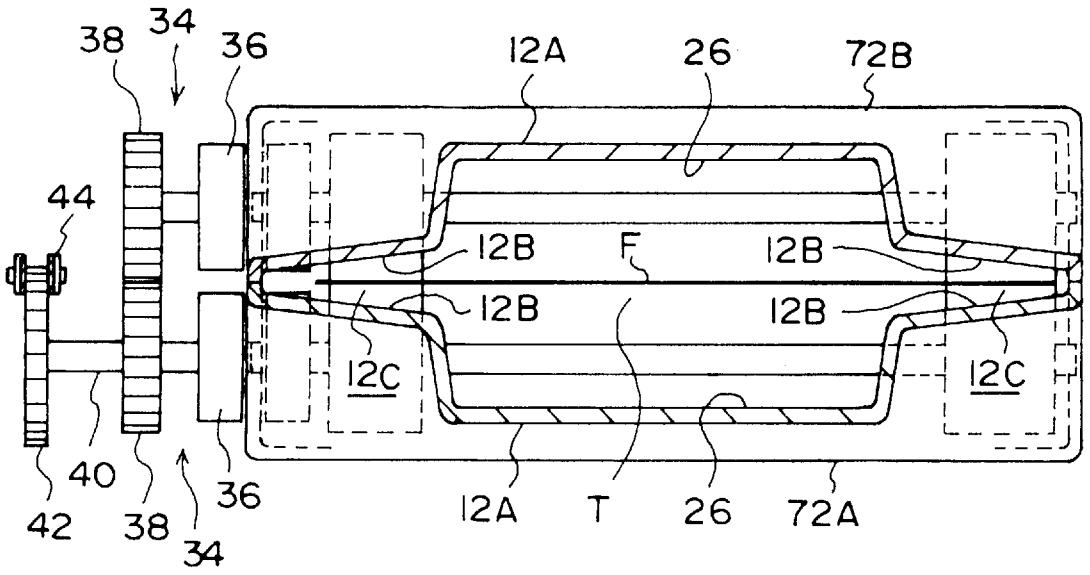
FIG. 3 is a view taken along line 3—3 in FIG. 2.

The developing tank 12 is illustrated in the enlarged view of FIG. 2, and the transverse cross-section of the developing tank 12 is illustrated in FIG. 3. As shown in FIG. 3, a space 12C in the developing tank 12 is formed in a slit shape in guide portions 12B, which are portions of the inner wall surface of the developing tank 12, so that the negative film F is guided and conveyed by the guide portions 12B.

More specifically, the space 12C is formed by the guide portions 12B in a slit-shape such that the transverse direction length of the space 12C in the developing tank 12 is slightly larger than the transverse dimension of the negative film F and such that the thickness of the space 12C is slightly larger than the thickness of the negative film F. As a result, the guide portions 12B form a U-shaped conveying path T for the negative film F. Concave portions 26 are formed in groove shapes along the conveying path T in wall portions 12A of the transverse direction central portion of the developing tank 12. The concave portions 26 are recesses in the top and bottom surfaces of the wall portions 12A as seen in FIG. 3. The concave portions 26 are formed so that the inner wall surfaces of the developing tank 12 do not contact the image forming portions of the negative film F.

Figure 6:
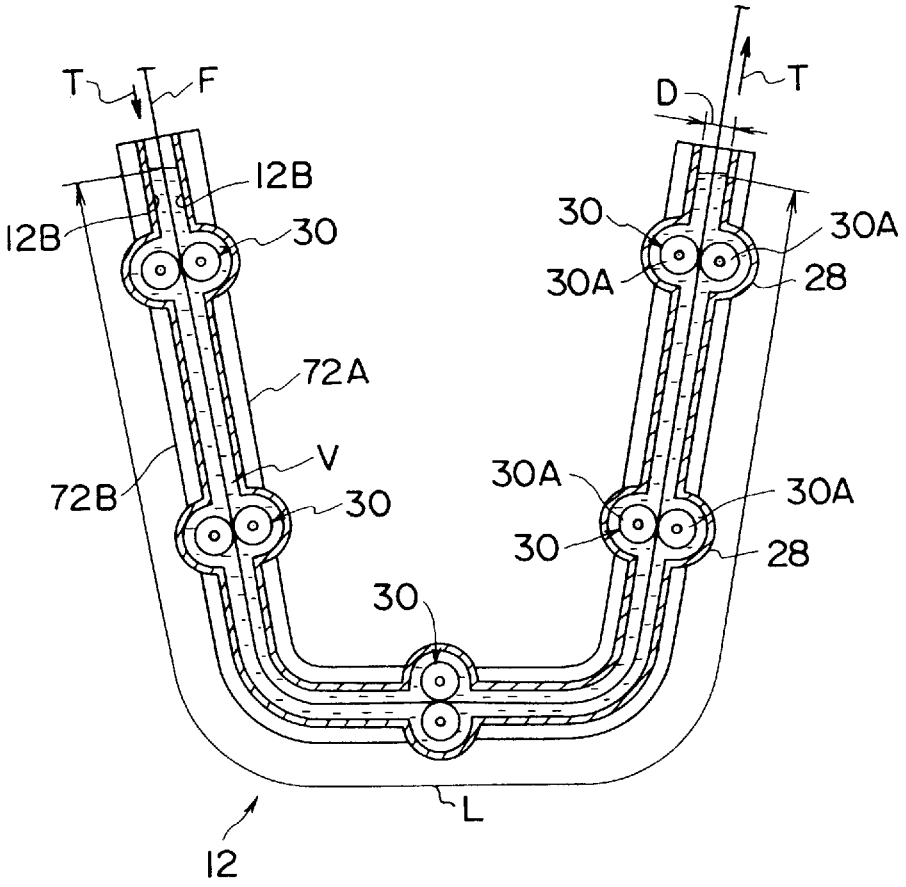
FIG. 6 is a cross-sectional view of the developing tank relating to the first embodiment of the present invention.

The developing tank 12 is a slit-shaped tank. As illustrated in FIG. 6, the tank volume of the developing tank 12 is V milliliters. The path distance, which is the conveying distance from the position at which the negative film F begins to contact the developing solution to the position at which the negative film F is discharged from the developing solution, is L cm. The developing tank 12 has a value of V/L of 25 or less, and is made to hold a small amount of developing solution.

The tank volume does not include the volume of the amount of solution in the circulation system or the volume of the subtank used for regulating the temperature of the developing solution, or the like.

Slit-shaped spaces are similarly formed in the inner portions of the other processing tanks such as the bleaching/fixing tank 14 and the stabilizing tanks 16. In the same way as the developing tank 12, the connecting members 18A, 18B, 18C, 18D are each formed in a U-shape having a slit-shaped path in the interior thereof. The connecting members 18A, 18B, 18C, 18D are disposed in inverse U-shapes in order to connect the developing tank 12, the bleaching/fixing tank 14, and the three stabilizing tanks 16.

Figure 4:
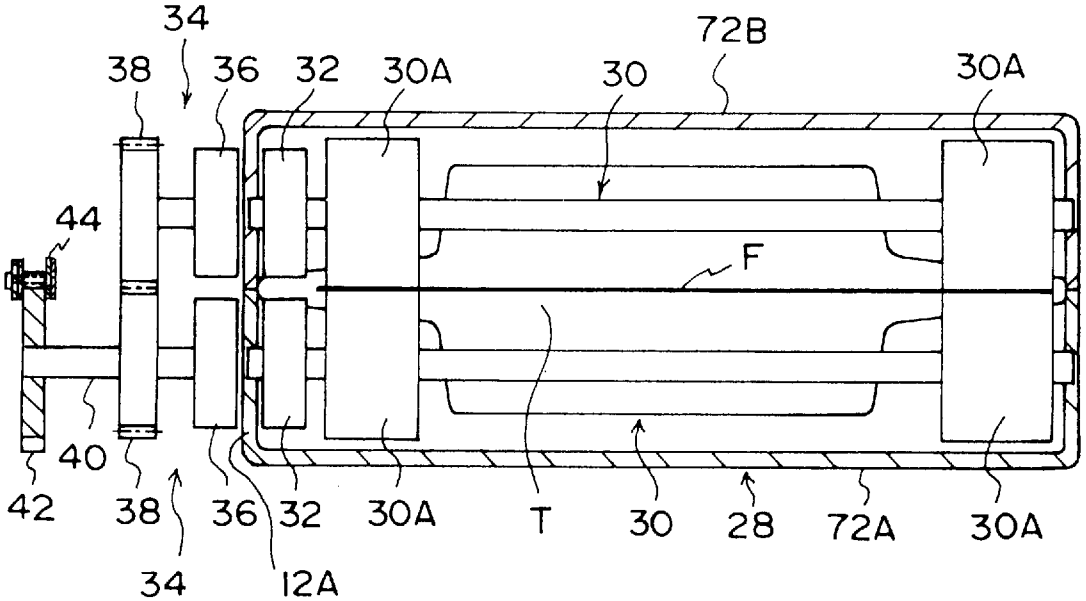
FIG. 4 is a view taken along line 4—4 in FIG. 2.

As illustrated in FIGS. 2 and 4, at the processing tank 12, bulging portions 28 which are swelled spaces are disposed at predetermined intervals at five places along the U-shaped conveying path T of the negative film F. A pair of conveying rollers 30, which are conveying means having drive wheels 30A at the ends thereof, are disposed in the bulging portions 28 so as to be rotable and so as to oppose one another.

Accordingly, when the pairs of conveying rollers 30 are rotated, the negative film F is conveyed along the conveying path T within the developing tank 12 while perforation portions of the negative film F are nipped between the drive wheels 30A of the pairs of conveying rollers 30.

A disc-shaped magnet 32, whose magnetic poles are disposed so as to be aligned along the peripheral direction, is mounted to one drive wheel 30A of each conveying roller 30. Transmission rollers 34 are disposed at the outer side portion of the developing tank 12 so as to oppose the magnets 32 of the conveying rollers 30 with the wall portion 12A of the developing tank 12 disposed therebetween. In the same way as the drive wheel 30A of the conveying roller 30, a disc-shaped magnet 36, whose magnetic poles are disposed so as to be aligned along the peripheral direction, is provided at one end side of the transmission roller 34, which is the end side which faces the magnet 32. A gear 38 is mounted to the other end side of the transmission roller 34. The gears 38 of the pair of transmission rollers 34 mesh with one another.

A sprocket 42 is mounted to the distal end portion of a rotating shaft 40 which projects further than the other end side of one of the transmission rollers 34 of the pair of transmission rollers 34. A plurality of the bulging portions 28 which house pairs of the conveying rollers 30 are formed as well at the other processing tanks such as the bleaching/fixing tank 14 and the stabilizing tanks 16. Pairs of the transmission rollers 34 having the sprockets 42 are disposed at these bulging portions 28 as well. A chain 44 is entrained around the respective sprockets 42 of the entire photosensitive material processing device 10. The chain 44 is driven to rotate by a motor 46 disposed within the photosensitive material processing device 10.

As the chain 44 is rotated by the motor 46, the ones of the transmission rollers 34 having the sprockets 42 are respectively rotated, and accordingly, the others of the transmission rollers 34 are also rotated due to the meshing together of the gears 38. As a result, the magnets 32 of the conveying rollers 30, which oppose the magnets 36 of the pair of transmission rollers 34 via the wall portions 12A of the developing tank 12, are effected by magnetism, and the pairs of conveying rollers 30 having the magnets 32 are rotated together with the pairs of transmission rollers 34.

As illustrated in FIG. 2, piping 52 which is a circulating path, is disposed so as to connect the central portion of the developing tank 12, which is the lowest portion, and portions of the developing tank 12 near the introduction and discharge sides. A pump 54, for sending the developing solution from the central portion of the developing tank 12 to the portions of the developing tank 12 near the introduction side and the discharge side, is disposed on the path of the piping 52. A cast heater 56, which heats the processing solution sent from the pump 54 to a predetermined temperature, is disposed at a position of the piping 52 downstream of the pump 54.

At a position of the piping 52 downstream of the cast heater 56, the piping 52 bifurcates so as to be connected to the portion near the introduction side of the developing tank 12 and to the portion near the discharge side of the developing tank 12.

One end of a piping 58, which is a replenishing path and which passes through the interior of the cast heater 56 in the same way as the piping 52, is connected to a portion of the piping 52 at the downstream side of the pump 54. The other end of the piping 58 is connected to a replenishing tank 60 in which replenishing solution is stored. A replenishing pump 62, for sending replenishing solution in the replenishing tank 60 into the piping 52, is disposed on the path of the piping 58. Accordingly, the cast heater 56 also heats the replenishing solution which is sent by the replenishing pump 62.

As disclosed in Japanese Patent Application Laid-Open JP-A) No. 5-80479 and Japanese Patent Application Laid-Open (JP-A) No. 5-204117, the cast heater 56 is formed such that a heater and pipes having good thermal conductivity are, together with a temperature sensor, cast in a metal having good thermal conductivity. Heat is transmitted rapidly and efficiently to the developing solution and the replenishing solution flowing through the pipes, so that the temperature of the developing solution within the developing tank 12 can be maintained at a constant temperature.

The temperature sensor detects the temperatures of the developing solution and the replenishing solution flowing in the pipings 52, 58. The operational state of the cast heater 56 can be adjusted on the basis of the temperatures of the developing solution and the replenishing solution detected by the temperature sensor.

The length of the piping 52 of the circulation system is made as short as possible, and the amount of developing solution held in the piping 52 is kept to a minimum. In this way, the amount of developing solution which is circulated in order to maintain the temperature of the developing solution can be kept to the minimum necessary amount, and the oxidization by air of the developing solution caused by agitation can be kept low as well.

A prescribed amount of replenishing solution is sucked out from the replenishing tank 60 by the replenishing pump 62. The replenishing solution passes through the piping 58 of the replenishing system and is supplied to the developing tank 12. When the replenishing solution passes through the unillustrated pipe within the cast heater 56, the temperature thereof is raised to the same temperature as that of the developing solution within the developing tank 12. The pipe of the replenishing system within the cast heater 56 is of a length which is sufficient for the temperature of the replenishing solution to be raised to a predetermined temperature during the time the replenishing solution passes through the pipe.

The replenishing solution is replenished immediately before a negative film F to be newly processed is inserted into the developing tank 12. At this time, the replenishing pump 62 is operated, and the prescribed amount of replenishing solution is replenished. The replenishing solution is also replenished during processing as needed. Accordingly, while the negative film F is being processed, the quality of the developing solution within the developing tank 12 is always maintained constant. The replenishing solution is supplied to the upper portion of the developing tank 12 into which the negative film F is inserted, either independently of or together with the developing solution from the bottom portion of the developing tank 12.

The amount of developing solution within the developing tank 12 temporarily increases by the amount of the replenishing solution which is supplied. However, as the negative film F is processed, this increased amount is discharged from the developing tank 12. An unillustrated overflow waste liquid opening may be provided at the negative film F discharge side of the developing tank 12 such that the increased amount may be discharged from the overflow waste liquid opening and stored in a waste liquid tank (not shown).

The replenishing solution is stored in the replenishing tank 60 which is a flexible, sealed container such as that disclosed in Japanese Patent Application Laid-Open (JP-A) No. 4-128841. As the replenishing solution in the interior of the replenishing tank 60 is sucked out by the replenishing pump 62, the replenishing tank 60 becomes flat.

Accordingly, air does not enter into the replenishing tank 60 and the replenishing solution does not oxidize, so that the initial quality of the replenishing solution can be maintained for a long time until the replenishing solution within the replenishing tank 60 is completely used.

Next, assembly of the photosensitive material processing device 10 of the present first embodiment will be described.

Figure 5:
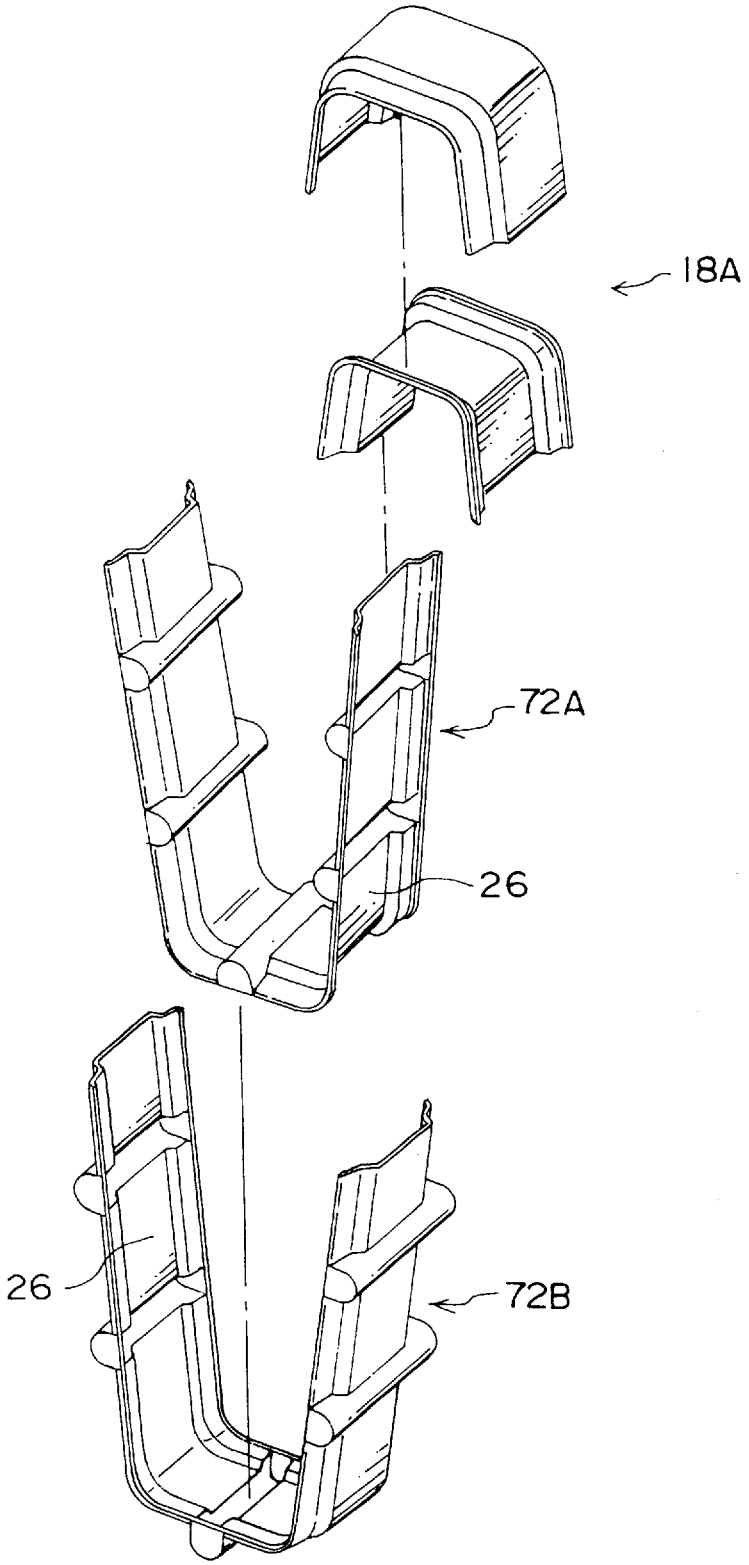
FIG. 5 is an exploded view of the developing tank and a connecting member relating to the first embodiment of the present invention.

First, as illustrated in FIG. 5, a pair of tank forming portions 72A, 72B are formed by injection molding. The tank forming portions 72A, 72B are each formed in a U-shape. The concave portion 26, which is a transverse direction central portion and which extends in a groove-shape along the longitudinal direction, is formed in each of the tank forming portions 72A, 72B.

With the pairs of conveying rollers 30 placed in the respective swelled portions of the tank forming portions 72A, 72B which are to become the bulging portions 28, the pair of tank forming portions 72A, 72B are adhered and joined together such that the concave portion 26 sides thereof oppose one another. In this way, the U-shaped developing tank 12 is formed.

The bleaching/fixing tank 14 and the stabilizing tanks 16 are formed in the same way as described above. The connecting members 18A, 18B, 18C, 18D are also formed by joining together unillustrated pairs of members which are similarly formed by injection molding.

Thereafter, the developing tank 12, the bleaching/fixing tank 14, the stabilizing tanks 16, and the connecting members 18A, 18B, 18C, 18D are assembled. The transmission rollers 34 are disposed so as to correspond to the bulging portions 28, and the chain 44 is entrained about the sprockets 42 of the transmission rollers 34. In the same way as the pipings 52, 58 to the developing tank 12, pipings are connected to the bleaching/fixing tank 14 and the stabilizing tanks 16, so as to enable the circulation of the processing solutions such as the developing solution and the addition of the replenishing solution. The photosensitive material processing device 10 is thereby completed.

Next, operation of the present first embodiment will be described.

The tank volume of the developing tank 12 which stores the developing solution is V milliliters. The path length, which is the conveying length from the position at which the negative film F begins to contact the developing solution within the developing tank 12 to the position at which the negative film F is discharged from the developing solution is L cm. The developing tank 12 is formed such that the value of V/L is 25 or less.

The piping 52, which circulates the developing solution within the developing tank 12, and the piping 58, which replenishes replenishing solution to the developing tank 12, are provided. The cast heater 56, which heats the developing solution within the piping 52 and the replenishing solution within the piping 58 to a predetermined temperature, is provided on the paths of the pipings 52, 58.

Accordingly, the developing tank 12 is long and narrow, has a V/L value of 25 or less, and holds only the minimum amount of developing solution. The cast heater 56 has good heat transfer and good thermal efficiency. Therefore, the cast heater 56 can heat the developing solution and the replenishing solution within the pipings 52, 58 to a predetermined temperature in a short time, and the temperature of the developing solution within the developing tank 12 can be stably maintained at a predetermined temperature. As a result, the photosensitive material processing device 10 is superior from the standpoints of cost and environmental conservation while developing processing is being carried out.

Further, because the value of V/L is 25 or less, as compared with the developing tank of a conventional processor FP360, the amount of developing solution can be reduced, there is no need for a large amount of replenishing solution in order to maintain the characteristics of the developing solution, and the operating cost of the photosensitive material processing device 10 can be reduced. Further, by reducing the amount of developing solution in accordance with the above-described structure, the developing tank 12 which stores the developing solution can be made compact, and accordingly, the photosensitive material processing device 10 can be made compact.

Immediately before a negative film F is to be processed at the developing tank 12 which holds a small amount of developing solution, the developing solution is circulated so that the temperature of the solution within the developing tank 12 is increased, and the replenishing solution whose temperature has been adjusted to a predetermined temperature is supplied. In this way, developing processing can be carried out with the quality of the developing solution and the processing conditions always maintained constant.

Accordingly, while developing processing is not being carried out, the circulating and agitating of the developing solution become less frequent, and the temperature of the developing solution is maintained at a temperature which is much lower than the processing temperature. As a result, even in cases in which the processing amount is low, deterioration of the quality of the developing solution is suppressed, and high-quality developing processing can be carried out without an increase in the amount of replenishing solution.

The solution capacity of the developing tank 12 and the piping system is a minimum capacity, and the amount of developing solution circulated is extremely small. In this way, oxidization by air and evaporation of the developing solution which accompany the circulation and agitation of the developing solution, can be kept to a minimum.

Processing in the developing tank of the present first embodiment will be described hereinafter.

Here, the conveying speed is 50 cm/min (8.3 mm/sec), and the gap D which is the slit width is about 0.8 cm.

| Processing Step | | | | | |
|---|---|---|---|---|---|
| Process | Processing Time | Processing Temperature | Amount Replenished | Tank Volume V | V/L |
| developing | 3 min 5 sec | 38.0° C. | 260 ml | 0.5 liters | 3.3 |

Developing processing of film processor FP360B manufactured by Fuji Photo Film Co., Ltd., which is one concrete example of a general film processor, is as follows.

| Process | Processing Time | Processing Temperature | Amount Replenished | Tank Volume V | V/L |
|---|---|---|---|---|---|
| developing | 3 min 5 sec | 38.0° C. | 260 ml | 11.5 liters | 82 |

The conveying speed here is 47 cm/min.

In the same way as described above, the other processing tanks such as the bleaching/fixing tank 14 and the stabilizing tanks 16 have a V/L value of 25 or less, and the same effects as those described above can be achieved.

The temperature of the developing solution is 45°, the temperature of the bleaching/fixing solution and the washing water is 40°, and the processing speed of the negative film F is adjusted such that the negative film F is immersed in each processing solution for 60 seconds. For example, the processing speed is from 0.1 m to 5 m per minute. The gap D of the interior portions of the processing tanks such as the developing tank 12 shown in FIG. 6 is from 0.1 cm to 10 cm.

A second embodiment of the photosensitive material processing device of the present invention is illustrated in FIGS. 7 through 16 and will be described on the basis of these figures. Members which are the same as those of the first embodiment will be denoted by the same reference numerals, and description thereof will be omitted.

Figure 7:
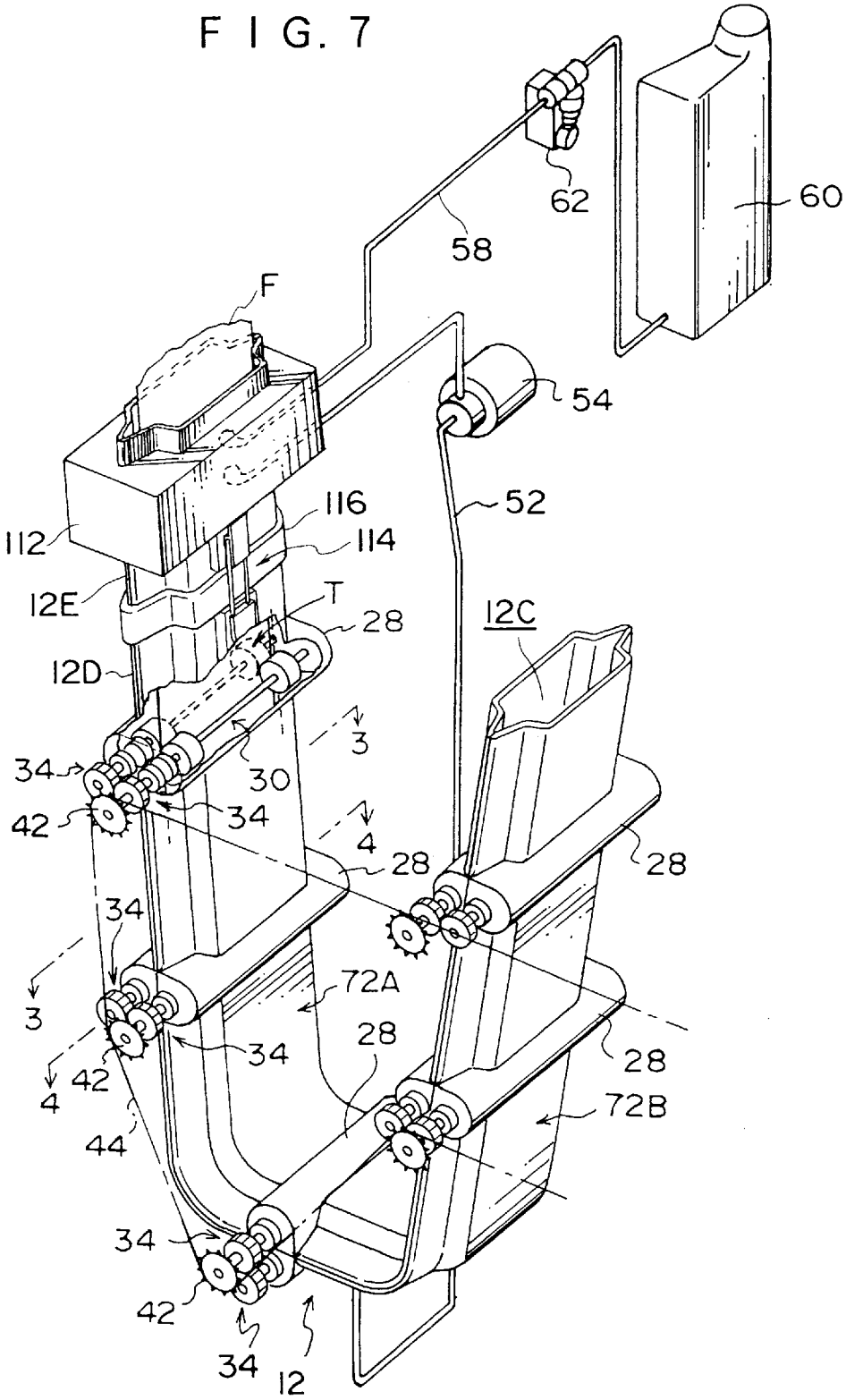
FIG. 7 is an enlarged schematic structural view of a periphery of a developing tank relating to a second embodiment of the present invention.
Figure 8:
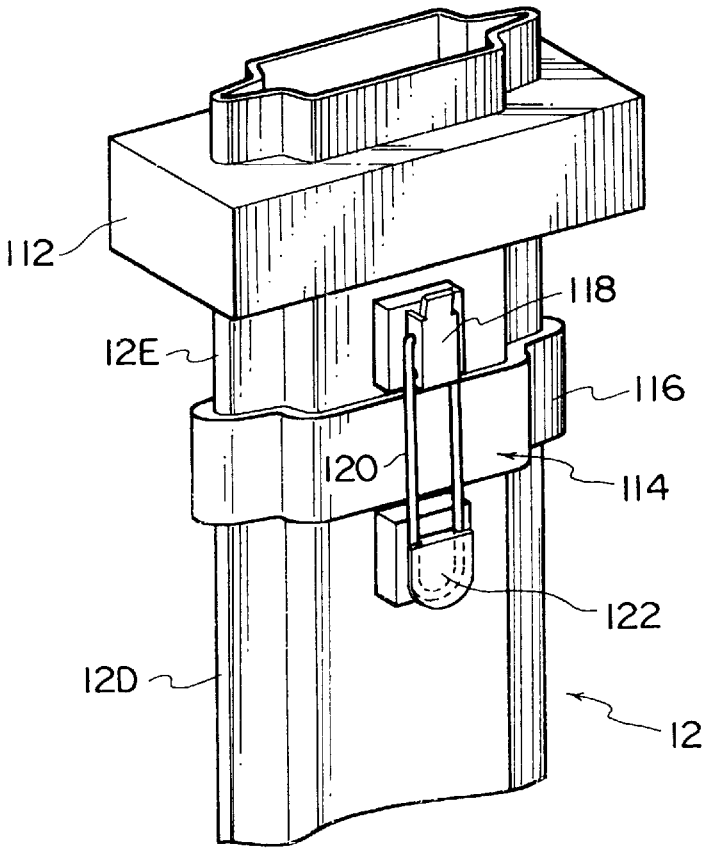
FIG. 8 is an enlarged perspective view of main portions of the developing tank relating to the second embodiment of the present invention.

As illustrated in FIGS. 7 and 8, a portion of the developing tank 12 relating to the present second embodiment is cast in a cast heater 112. The pipings 52, 58 are connected to the cast heater 112.

The developing tank 12 which is cast in the cast heater 112 is structured such that two metal plates having good thermal conductivity and good corrosion-resistance are press molded, the plates are welded together so as to form a tank, and the formed tank is cast integrally with the heater. The cast heater 112 is mounted to a position below the liquid surface of the processing solution such as the developing solution or the like, such that there is always solution at this position.

Examples of metals which are highly corrosion-resistant are SUS316, titanium, Hastelloy, inconel, and the like.

An insertion portion 12E of the developing tank 12, in which the negative film F is inserted, is disposed at the cast heater 112. The insertion portion 12E is fit with and connected to a main body 12D of the developing tank 12. The insertion portion 12E and the main body 12D are fixed by a fixing member 114.

Figure 9:
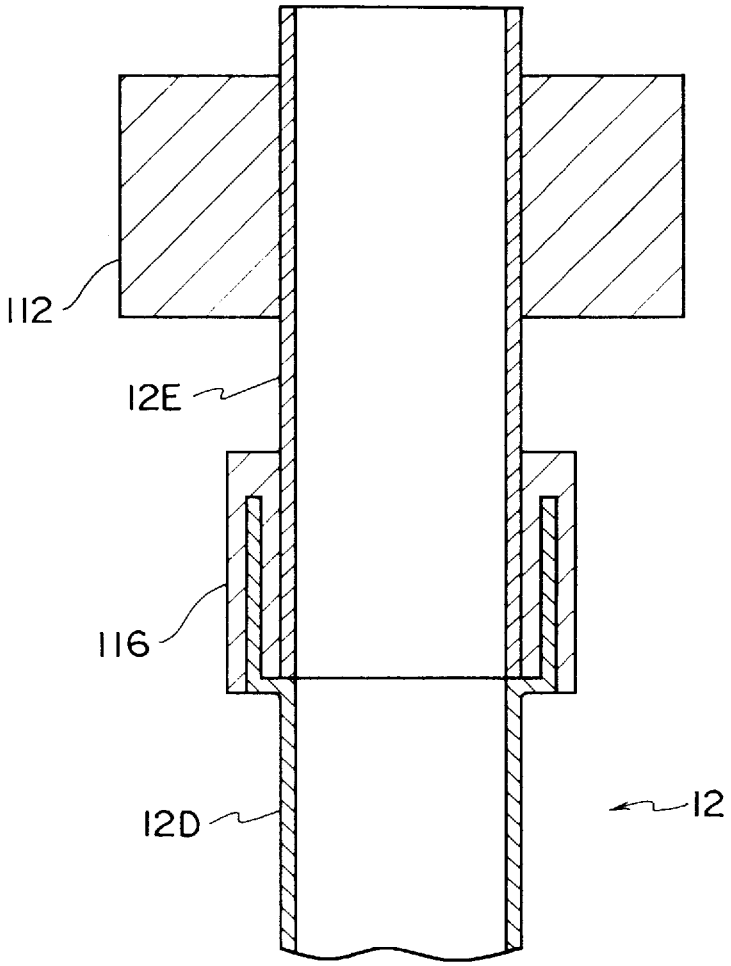
FIG. 9 is an enlarged cross-sectional view of main portions of the developing tank relating to the second embodiment of the present invention.

More specifically, as illustrated in FIG. 9, an elastic body 116, which is annular and formed of a rubber material having low hardness, is attached to the main body 12D side of the developing tank 12. By fitting the bottom end portion of the insertion portion 12E in the inner portion of the elastic body 116, solution can be prevented from leaking from the connecting portion between the main body 12D and the insertion portion 12E of the developing tank 12.

As illustrated in Pigs. 8, 10, and 11, rotating hardwares 118 to which loop-shaped wires 120 are attached, are rotatably supported at the insertion portion 12E of the developing tank 12. Receiving hardwares 122 on which the wires 120 are latched are fixed to the main body 12D of the developing tank 12. The fixing member 114 is formed by the wires 120, the rotating hardwares 118 and the receiving hardwares 122.

Figure 10:
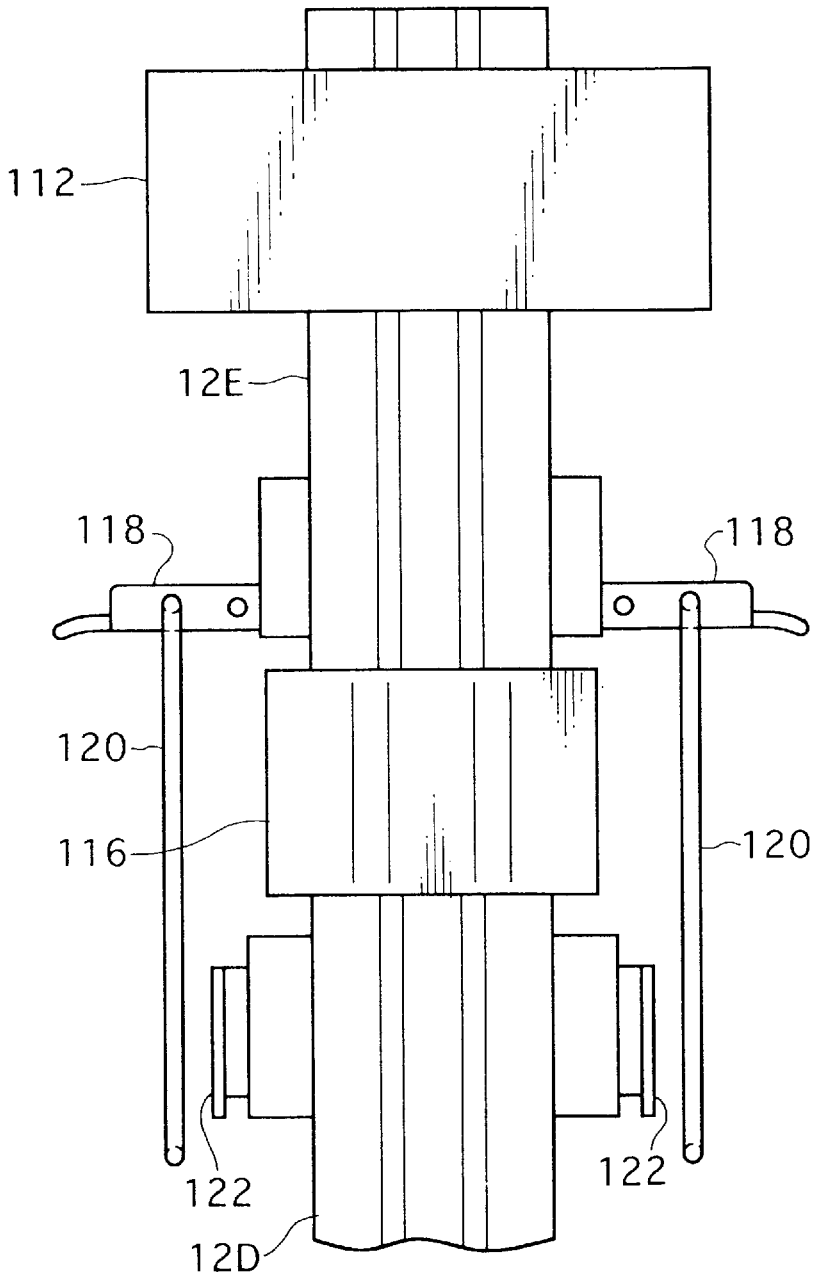
FIG. 10 is an enlarged side view of main portions of the developing tank relating to the second embodiment of the present invention, and illustrates a state before connecting of an introduction portion.
Figure 11:
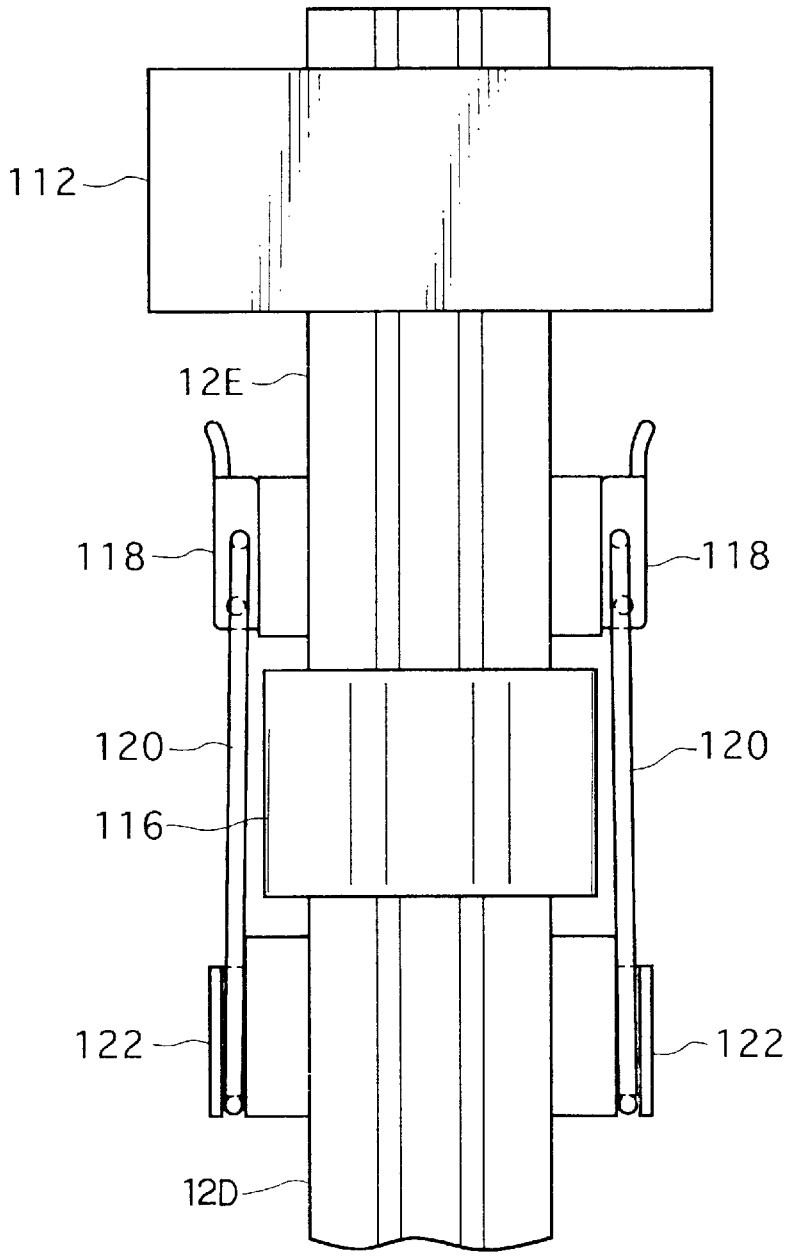
FIG. 11 is an enlarged side view of main portions of the developing tank relating to the second embodiment of the present invention, and illustrates a state after connecting of the introduction portion.

Accordingly, from the state illustrated in FIG. 10, the wires 120 are latched on the receiving hardwares 122 and the rotating hardwares 118 are rotated so as to move to the state illustrated in FIG. 11. In this way, the insertion portion 12E is connected to the main body 12D of the developing tank 12 as illustrated in FIGS. 7 and 8.

Figure 12:
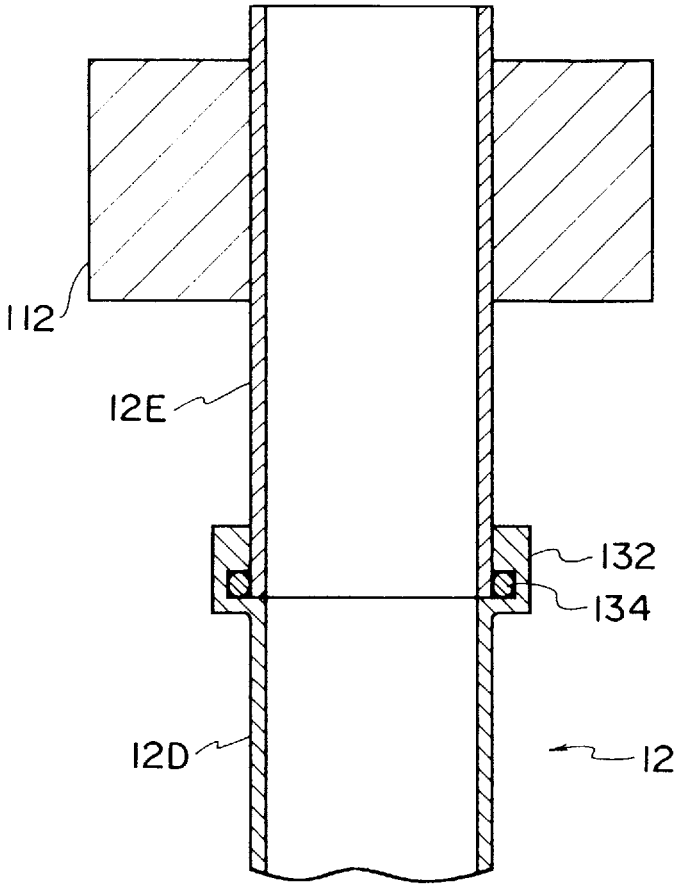
FIG. 12 is an enlarged cross-sectional view of main portions of a developing tank relating to a modified example of the second embodiment of the present invention.

A modified example of the present second embodiment is illustrated in FIG. 12. In place of the elastic body formed annularly from a rubber material, an annular fitting portion 132 made of resin is formed at the main body 12D of the developing tank 12, and a rubber ring 134 such as an O-ring or the like is disposed at the inner peripheral surface of the fitting portion 132 so that leaking of the solution can be prevented.

Figure 13:
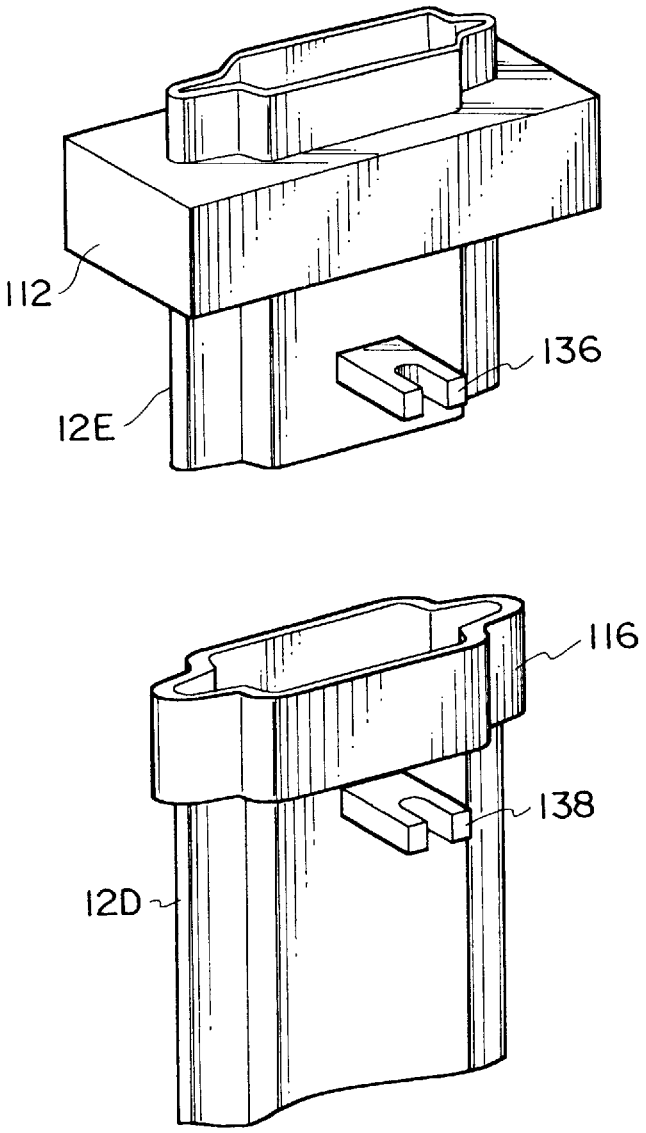
FIG. 13 is an enlarged perspective view of main portions of a developing tank relating to a modified example of the second embodiment of the present invention, and is a perspective view illustrating a state before connecting of an introduction portion.
Figure 14:
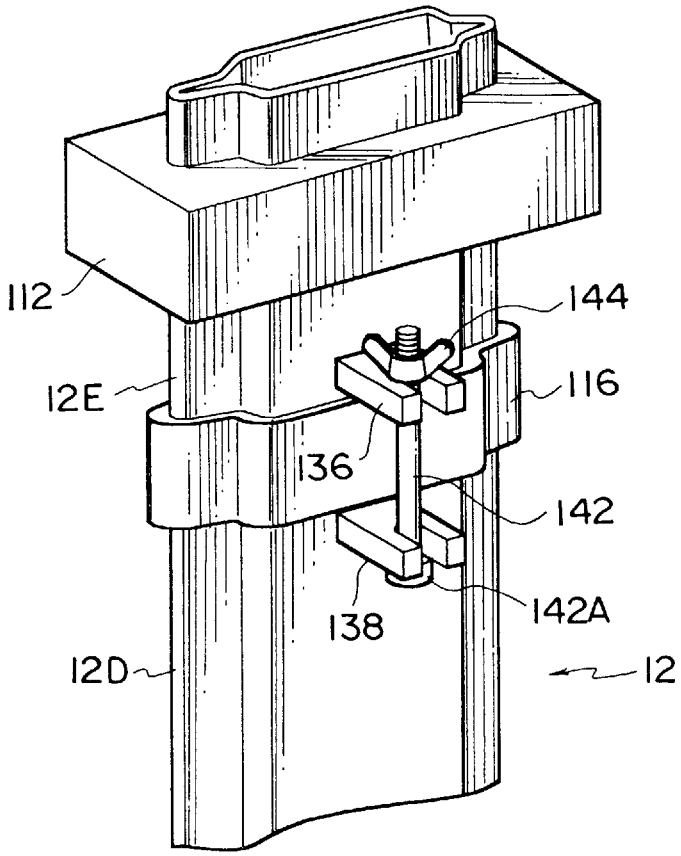
FIG. 14 is an enlarged perspective view of main portions of the developing tank relating to the modified example of the second embodiment of the present invention, and is a perspective view illustrating a state after connecting of the introduction portion.
Figure 15:
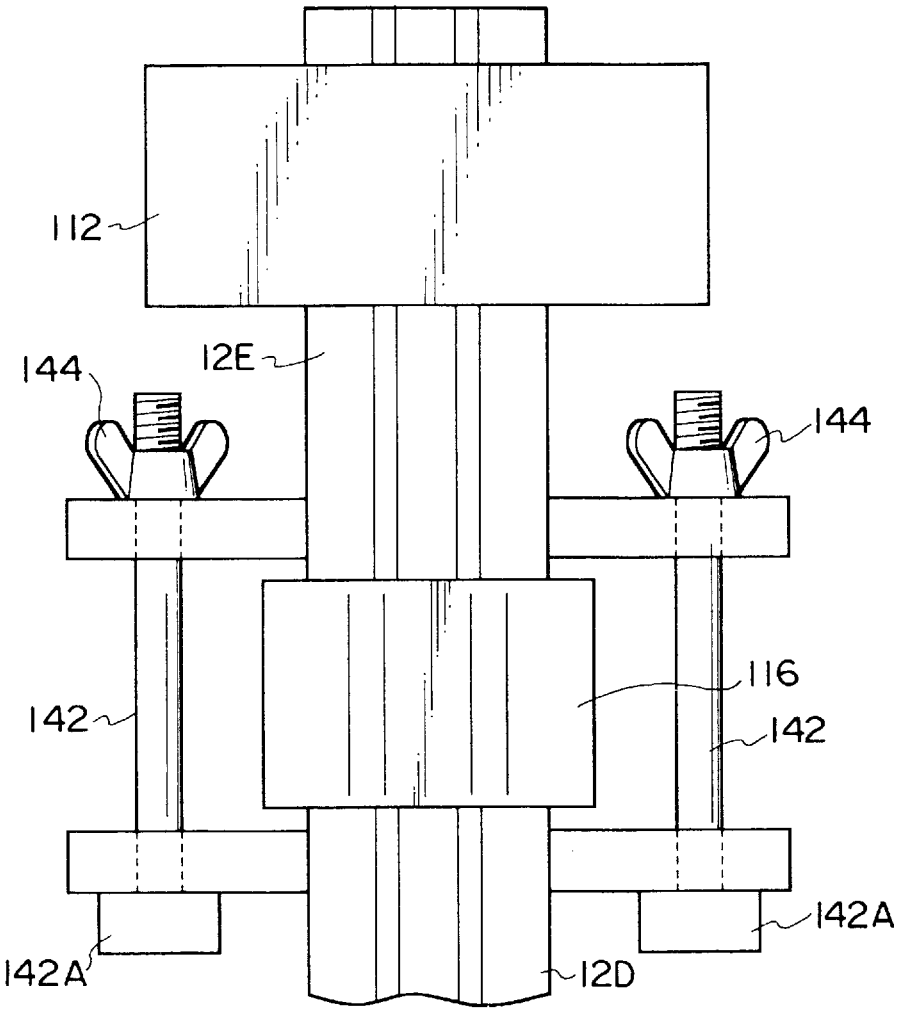
FIG. 15 is an enlarged side view of main portions of the developing tank relating to the modified example of the second embodiment of the present invention, and is a side view illustrating a state after connecting of the introduction portion.

Further, in place of the fixing member 114, as illustrated in FIGS. 13 through 15, brackets 136,138, which each have a concave portion through which a bolt 142 can be inserted, may be provided at the insertion portion 12E and the main body 12D of the developing tank 12 respectively. As shown in FIGS. 14 and 15, the bolts 142 are inserted into the concave portions, and head portions 142A of the bolts 142 and nuts 144 engage with the brackets 136, 138 so as to connect the insertion portion 12E to the main body 12D.

Figure 16:
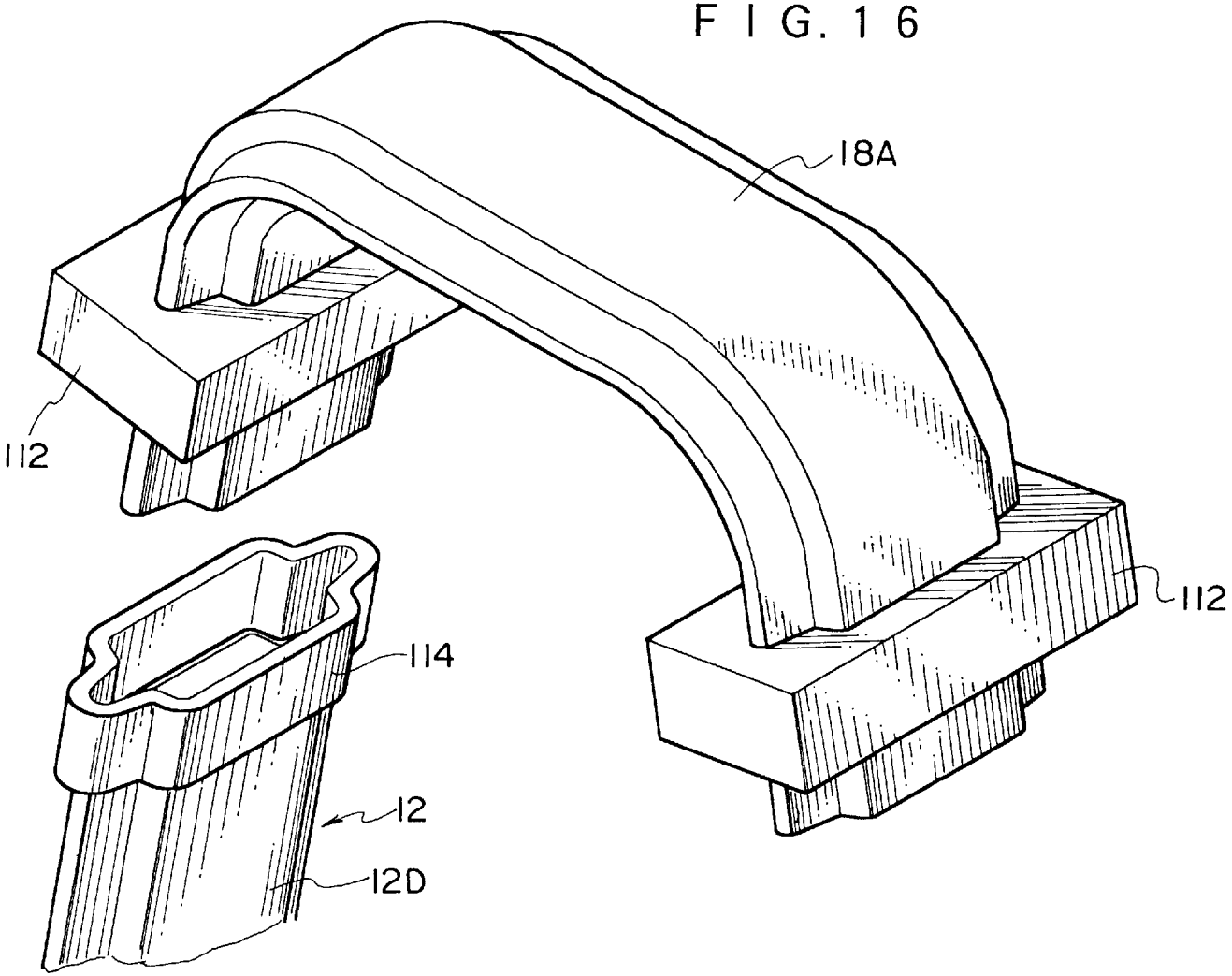
FIG. 16 is an enlarged perspective view of a connecting member relating to the second embodiment of the present invention.

As illustrated in FIG. 16 by using the connecting member 18A as an example, the cast heaters 112 may be provided at the insertion side and the discharge side of the connecting members 18A, 18B, 18C, 18D where the processing solution and the replenishing solution should be heated at the discharge side of the developing tank 12 and at the bleaching/fixing tank 14 and the stabilizing tanks 16. In this case, the connecting members 18A, 18B, 18C, 18D are formed from a metal having good thermal conductivity, and are cast together with the heaters.

The cast heaters 112 are mounted to positions lower than the surfaces of the solutions so that there is always solution at the mounting positions.

Next, operation of the present second embodiment will be described.

The cast heater 112 which heats the developing solution and the replenishing solution in the pipings 52, 58 to a predetermined temperature is mounted to the developing tank 12 or to the periphery thereof. As a result, the cast heater 112 is directly mounted to the developing tank 12, and the heat from the cast heater 112 is transferred more efficiently so that more precise temperature management of the developing solution can be effected.

Further, because the cast heater 112 is mounted to the developing tank 12 so as to be attachable thereto and removable therefrom, in a case in which there is trouble with the cast heater 112 or the like, the cast heater 112 can be easily replaced at the respective insertion portions 12E.

Figure 17:
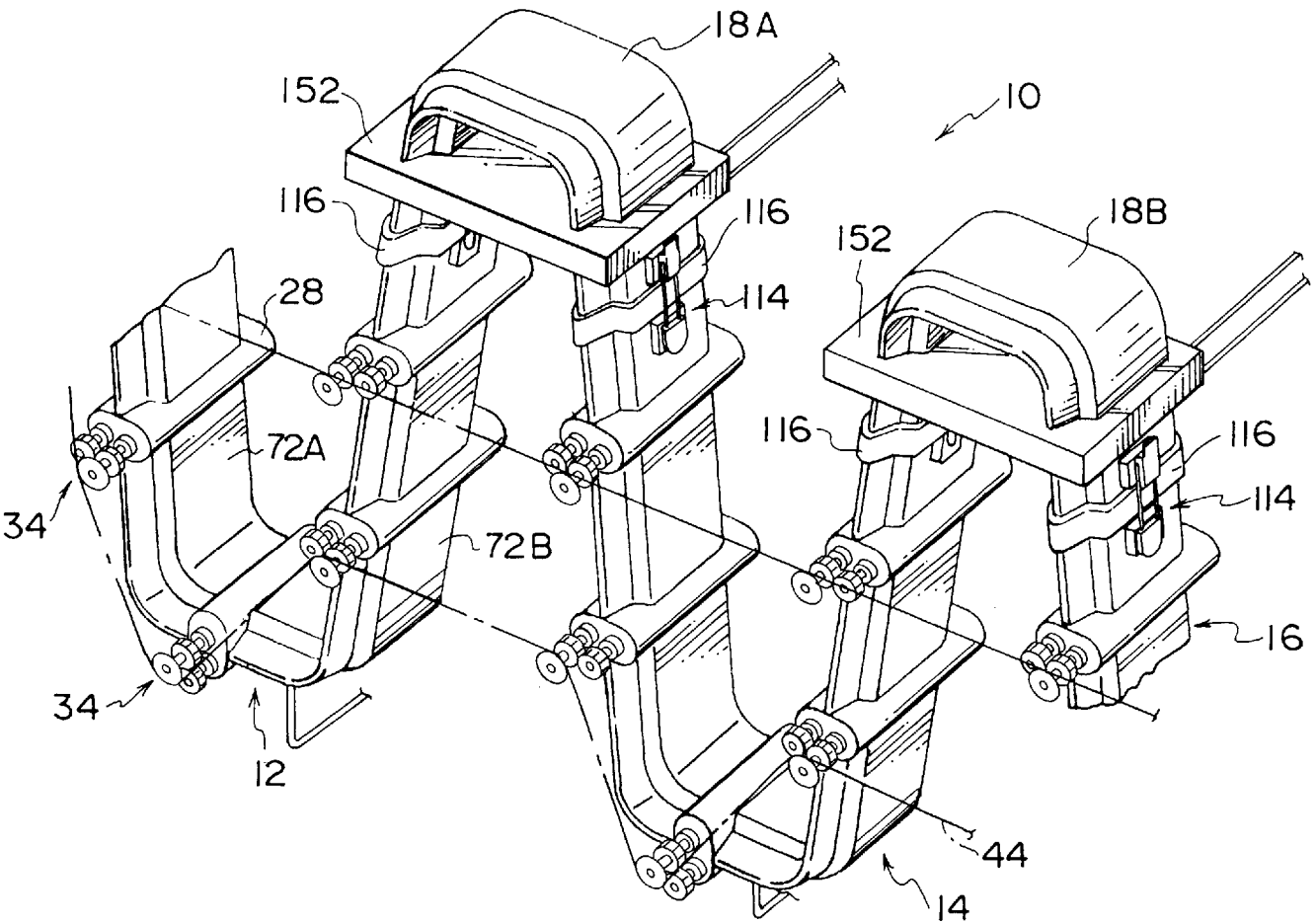
FIG. 17 is a schematic structural view of a photosensitive material processing device relating to a third embodiment of the present invention.

A third embodiment of the photosensitive material processing device of the present invention is illustrated in FIG. 17 and will be described on the basis of this figure. Members which are the same as those of the first and second embodiments are denoted by the same reference numerals, and description thereof is omitted.

As illustrated in FIG. 17, in place of the structure of FIG. 16, the photosensitive material processing device 10 relating to the present third embodiment is provided with cast heaters 152 which are cast integrally with and connected to the introduction sides and the discharge sides of the connecting members 18A, 18B, 18C, 18D. Therefore, the present third embodiment exhibits the same effects as those of the above-described embodiments, and moreover, the process of manufacturing the cast heaters 152 is simplified.

Figure 18:
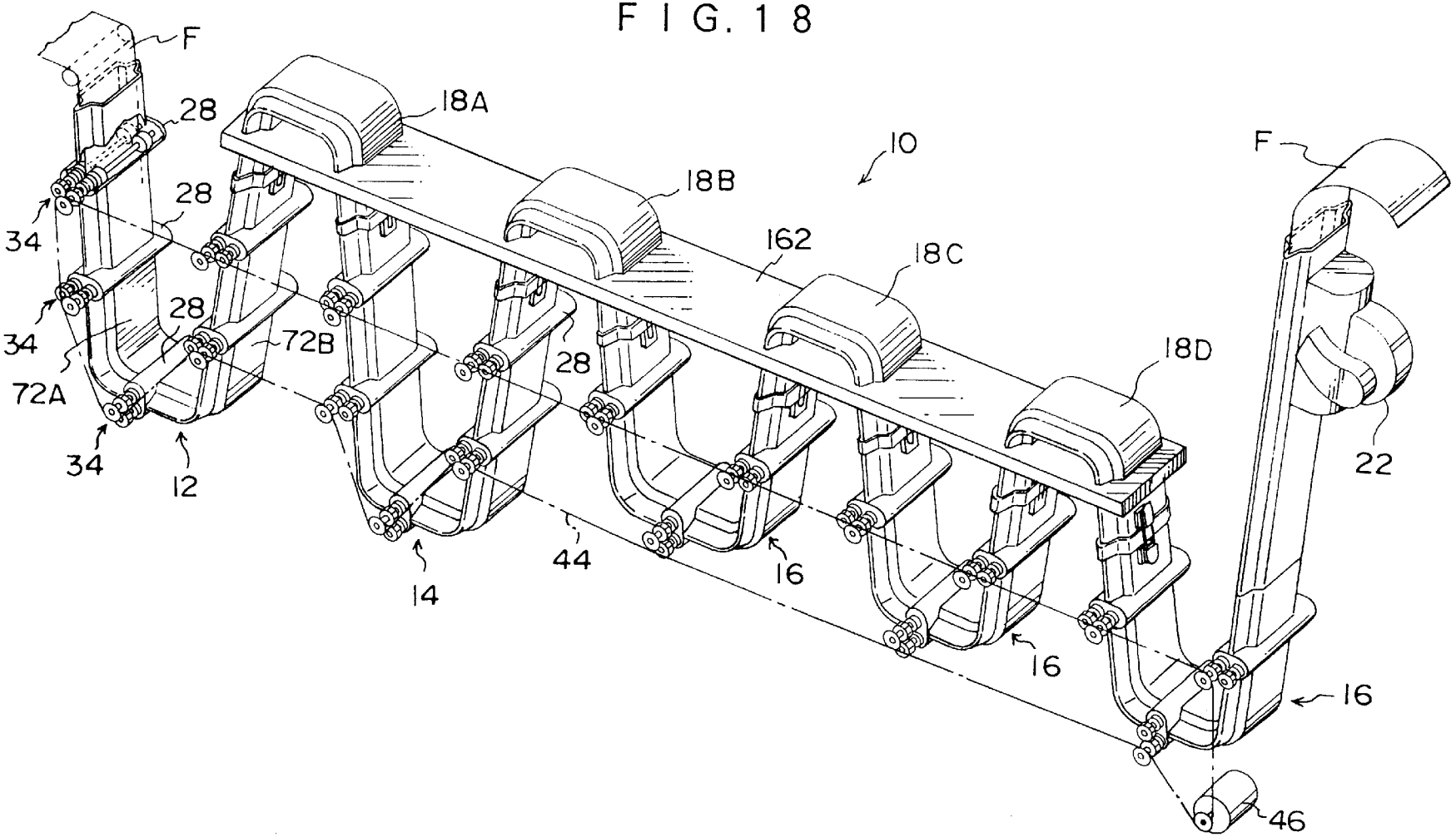
FIG. 18 is an overall schematic structural view of a photosensitive material processing device relating to a fourth embodiment of the present invention.

A fourth embodiment of the photosensitive material processing device relating to the present invention is illustrated in FIG. 18, and is described hereinafter on the basis of this figure. Members which are the same as those of the first through the third embodiments are denoted by the same reference numbers, and description thereof is omitted.

As illustrated in FIG. 18, the photosensitive material processing device 10 of the present fourth embodiment is provided with a cast heater 162 at which the connecting members 18A, 18B, 18C, 18D are integrally cast and connected. Therefore, the present fourth embodiment exhibits the same effects as those of the above-described embodiments, and moreover, maintenance of the photosensitive material processing device 10 is simplified.

Examples of the crystalline resin which forms the processing tanks in the above-described embodiments are PE (polyethylene), PP (polypropylene), PA (polyamide), POM (polyacetal), PBT (polybutylene terephthalate), PET (polyethylene terephthalate), PPS (polyphenylene sulfide), fluoroplastics (PTFE (polytetrafluoroethylene), PFA (polytetrafluoroethylene/perfluoroalkylvinylether copolymer), FEP (polytetrafluoroethylene/hexafluoropropylene copolymer), ETFE (ethylene/polytetrafluoroethylene copolymer), PCTFE (polychloridetetrafluoroethylene), ECTFE (ethylene/ polychloridetetrafluoroethylene copolymer), PvdF (polyvinylidene fluoride), PvF (polyvinylfluoride)), and the like.

These resin materials are particularly suited for the guide portions 12B and portions at the liquid surface where it is easy for the processing solution (e.g., color developing solution) to precipitate. Further, the processing tanks may be formed by these resin materials by injection molding or the like. The above-described fluorides may be used as a surface treatment material such as a coating or a lining or the like on another material such as PPE or the like. The effects can be exhibited in this way as well.

The processor which is the photosensitive material processing device 10 relating to the embodiments of the present invention can utilize any of various types of conveying methods other than that of the above-described embodiments. Various conveying methods will be described hereinafter.

So-called drum processing, in which a photosensitive material is, by the rotation of a drum, inserted, conveyed and sent out from processing solution filled into a narrow gap, is known as a conveying mechanism ("Photograph Industry" ("Shashin Kogyo"), December 1974, p. 45). In this method, the photosensitive material which is the negative film F is developed by using the inner wall or the outer wall of the drum. The outer wall type is preferable from the standpoint of ease of manufacturing a processing tank device holding a small amount of solution.

Roller conveying-type processors are known which convey photosensitive materials by the nip force of rollers such as opposing rollers, staggered rollers or the like ("Photograph Industry" ("Shashin Kogyo") , February 1975, p. 71).

This method is preferably used in the present invention from the standpoint of ease of manufacturing a small device. Further, it is even more preferable to use a method in which a groove through which the photosensitive material passes is provided and the conveying route is controlled, as disclosed in Japanese Patent Application Laid-Open (JP-A) No. 4-95953. This method is appropriate for the conveying of photosensitive materials having a thick substrate. The opposing roller type is preferable for photosensitive materials having a thin substrate.

Moreover, when photosensitive materials having a thin substrate are to be conveyed, it is preferable to provide many pairs of opposing rollers or to join the photosensitive material to the trailing end of a thick substrate (also called a tab leader) and to process the photosensitive material in this manner. Depending on the case, a feed mechanism (insertion mechanism) may be provided at the insertion portion of the processing tank.

There exist methods in which a photosensitive material is processed by joining an exposed photosensitive material to the trailing end of a leader, which has been passed in advance into the processing tank, and driving is carried out so that the leader is taken up. For photographed photosensitive materials, this method is known as cine-type developing, and for printed photosensitive materials, this method is known as leader-trailer conveying developing ("Photograph Industry" ("Shashin Kogyo"), March 1975, page 70; April 1975, page 40; May 1975, page 36; June 1975, page 41).

In these processing methods, it is necessary to attach elongated leaders to the leading end and the trailing end of the photosensitive material and process the photosensitive material. These methods are applicable to cases in which it is necessary to process a large amount of print photosensitive materials.

Similar conveying methods are an endless leader belt method and an endless chain method ("Photograph Industry" ("Shashin Kogyo"), May 1975, page 36; June 1975, page 41).

However, in these methods, much solution is taken out and brought in, and therefore, these methods are not appropriate for the present invention.

Among methods in which an exposed photosensitive material is attached to the trailing end of a leader which has been passed in advance into the processing tank, recently, a method has been used in which the leader is not elongate but is short (and hence called a "short leader"), and the short leader is moved by a special driving. Such a method is applicable to the present invention, and is one preferable aspect.

In this method, the short leader is moved by the rotation and movement of a belt (timing belt) having a plurality of convex portions corresponding to holes formed in the short leader, and as a result, the photosensitive material is processed.

In another method, the short leader is moved by the rotation of a gear (or sprocket) having convex portions corresponding to holes formed in the short leader, and the photosensitive material is processed. An example of this method is disclosed in Japanese Patent Application Laid-Open (JP-A) No. 4-101139.

This method is one preferable conveying method. In particular, the method of conveying by using a sprocket is preferable.

Methods of processing by using a small amount of solution such as in the present invention include a belt conveying method, an endless belt method, a magnetic conveying method, a sprocket conveying method and the like. Belt conveying methods are disclosed in Japanese Patent Application Laid-Open (JP-A) No. 2-67551 and Japanese Patent Application Laid-Open (JP-A) No. 2-103043. Endless belt methods are disclosed in Japanese Patent Application Laid-Open (JP-A) No. 2-67550 and Japanese Utility Model Application Laid-Open (JP-U) No. 2-58744. A magnetic conveying method is disclosed in Japanese Patent Application Laid-Open (JP-A) No. 1-154155. A sprocket conveying method is disclosed in Japanese Patent Application Laid-Open (JP-A) No. 4-101139.

It is preferable that the processing solutions be circulated in the processing tanks of the present invention for temperature control and the removal of suspended matter. The speed of the circulation depends on the size of the processing tank and is 0.1 to 30 liters per minute, and preferably 0.2 to 10 liters per minute. If the circulation is too weak, it is difficult to control the temperature, whereas if the circulation is overly strong, the solution may deteriorate or overflow.

It is preferable that the circulation method applied to the present invention is a method in which the circulating system sucks in processing solution from the bottom portion of the processing tank, and discharges processing solution into the upper portion of the tank. Here, the upper portion of the tank means a position which is at a depth of 10 cm or less from the surface of the solution. It is particularly preferable to discharge solution at this position. Further, in order to prevent the overflow of solution due to pressure at the upper portion of the liquid surface, a method of covering the vicinity of the liquid surface by a wiper blade or the like may preferable be used. This wiper blade may simultaneously be used as a squeegee.

Magnet pumps MD-10, MD-20, MD-30 manufactured by Iwaki Co. are preferably used as the pump for circulation.

Jet openings which strongly jet solution may be provided at the circulating system (jet agitation). The jetted solution contacts the film surface of the photosensitive material so that the desired photographic characteristic are obtained in a short time, the desilverizing speed is increased, and the washing away of various components in the water washing baths and stabilizing baths is accelerated.

Methods of jet agitation are disclosed in Japanese Patent Application Laid-Open (JP-A) Nos. 3-41447, 4-83251, 5-11421, 5-224382, 5-281688, 7-199436 and the like.

A method of jet agitation in processing solutions is disclosed in Japanese Patent Application Laid-Open No. 62-183460, page 3, lower right column through page 4, lower right column in the "Examples". This method is a method of emitting solution which is force-fed by a pump from nozzles provided so as to oppose the emulsion surface, and is a preferable method.

Magnet pumps MD-10, MD-15, MD-20 or the like manufactured by Iwaki Co. can be used as the pump. The nozzle hole diameter is 0.3 to 2 mm, and preferably 0.5 to 1.5 mm. It is preferable that the nozzles are formed as circles and are set as orthogonally as possible with respect to the surface of the chamber plate and the surface of the photosensitive material. However, an angle of 60 degrees to 120 degrees from the conveying direction and a rectangular or slit-shaped configuration may also be used. The number of nozzles is, per 1 liter tank volume, 5 to 200 and preferably 10 to 100.

When the jetted flow hits only a portion of the photosensitive material, developing irregularities or residual-color irregularities are generated. Therefore, it is preferable to successively offset the positions of the nozzles so that solution is not jetted to the same place. For example, the positions of hole rows of 2 to 8 holes may be changed slightly at appropriate intervals perpendicularly to the conveying direction. If the distance from the nozzles to the photosensitive material is too short, it is easy for the aforementioned irregularities to occur, whereas if the distance is too far, the agitating effect weakens. The distance is preferably 0.5 to 12 mm, and more preferably 1 to 9 mm.

The rate of flow of the solution emitted from the nozzles is similarly in an optimal range, and is preferably 0.5 m/sec to 5 m/sec, and rates of flow of 1 m/sec to 3 m/sec are particularly preferable.

Because developing processing is generally a chemical reaction, managing the temperature such that the temperature during developing is a designated temperature and falls within a given range of deviation is essential in order to stabilize the photographic characteristics. In particular, in an automatic developing device, stable temperature management is important because there is no person checking the temperature.

Such automatic control and homogeneous control of temperature in an automatic developing device are called temperature regulation. Temperature regulation functions to maintain the temperature of the solution in the processing tank at a designated temperature and to maintain the temperature homogeneously.

Accordingly, the functions of temperature regulation can be divided amongst a heating section, a cooling section (this is not necessary when air cooling is used), a solution circulating section, and a temperature detecting section. The temperature detecting section is needed for temperature control, and it is preferable that the temperature detecting section is set at the processing tank (see Japanese Patent Application Laid-Open (JP-A) No. 1-170944).

There are cases in which a combination of the functions of the heating section, the cooling section, and the solution circulating section is carried out within the processing tank, and there are cases in which the functions are carried out in a separate tank, and there are intermediate cases.

In a processing tank for a small amount of solution, it is preferable that at least the heating section and the solution circulating section are provided outside of the processing tank. It is preferable that the heating section is disposed within a subtank (a tank which is open to air and connected directly to the processing tank), or that the heating section is disposed on the path of circulation, or that the heating section is disposed within a hump tank (a tank not open to air: a replenishing mixing tank) disposed on the path of circulation. An axial flow (propeller) pump and a so-called chemical pump are often used for the pump used for circulation. However, a screw pump, a gear pump, a piston pump or the like may be used.

The heater used in the heating section may be a stainless heater in which a nichrome wire is embedded in an insulator, a ceramic heater using heat generated by a ceramic, a planar heater using heat generated by carbon fibers, a cast heater (in which a heater and a pipe through which solution whose temperature has been adjusted are cast together in a volume-type heater) or the like (Japanese Patent Application Laid-Open No. 62-246057). However, in light of the object of the present invention, a method in which a cast heater is used and the heater is built into the circulation system results in a small increase in the amount of solution, and is the most preferable method.

Such a cast heater is disclosed in detail in Japanese Patent Application Laid-Open Nos. 5-80479 and 5-204117.

The flow of circulation for efficiently regulating the temperature of the processing tank of a small liquid amount depends on the method of circulation. If, for example, a U-shaped slit-type processing tank such as that illustrated in FIG. 1 of Japanese Patent Application Laid-Open (JP-A) No. 4-83251 is used, a method in which solution is removed from the bottom portion of the U-shaped tank and is returned to top portions at both sides of the U-shape is preferable. As is illustrated in FIG. 1 of JP-A-4-83251, when the solution is returned, it is most preferable for the solution to be emitted from nozzles, which are slits extending in the transverse direction of the photosensitive material, so as to be emitted uniformly along the entire width of the photosensitive material.

In a case in which the solution is removed from an upper portion of the U-shape and returned to another upper portion of the U-shape and there is a subtank, generally, a method in which solution is removed from the subtank is preferable in order to stabilize the temperature regulation. In this case, a blade for preventing solution from being emitted may be provided at the liquid surface upper portion at the returning side. For example, the wiper member 78 of FIG. 2 of Japanese Patent Application Laid-Open No. 3-257450 is preferably used.

In this case, if a structure for stabilizing the temperature regulation of the subtank is employed, a blade for preventing solution from spilling out is not needed in a method in which solution is removed from the top portion of a U-shape which does not have a subtank and the solution is circulated.

Control for maintaining the temperature constant is also needed. Specifically, control against a drop in temperature when the photosensitive material enters in the solution or when solution is replenished, control for preventing heating of the heater, energy-saving control, outside air temperature estimation, and other functions are used. Such functions are disclosed in, for example, Japanese Patent Application Laid-Open (JP-A) Nos. 58-211149, 62-238556, 62-238557, 62-246058, 1-177542, 1-200421, 1-214850.

It is preferable that the processing device of the present invention has a function for replenishing in accordance with the amount of the exposed photosensitive material which is processed.

Any of various methods of replenishing can be used. The following are examples of methods which may be used. Japanese Patent Application Laid-Open (JP-A) No. 5-173299 discloses a method of replenishing a direct concentrated liquid of a replenishing system. Japanese Patent Application Laid-Open (JP-A) No. 6-194811 discloses a method in which concentrated liquid is stocked in a stock tank and thereafter replenished. Japanese Patent Application Laid-Open (JP-A) Nos. 64-55560, 64-55561, and 64-55562 disclose methods for replenishing complete solution which replenish complete solution directly to a processing tank from a complete solution cartridge. Japanese Patent Application Laid-Open (JP-A) No. 3-134666 discloses a method of automatically supplying replenishing solution to a stock tank from a cartridge, and thereafter, replenishing the processing tank. EP-590583A1 discloses a method of replenishing concentrated liquid and water directly to a processing tank. Japanese Patent Application Laid-Open (JP-A) Nos. 5-188533, 6-202297, and 7-169339 disclose methods of replenishing a solid processing agent and water.

In the processing device of the present invention, because the opening surface area of the liquid surface is relatively small, it is preferable to provide a circulating system and a subtank and to replenish solution to these portions. Further, when solution is to be replenished to the circulation system, it is preferable to provide a bulge at one portion of the circulation path (a hump tank) and to replenish solution to this portion.

A replenishing pump is used to replenish the processing solution, and it is preferable to use a bellows-type replenishing pump. As a method of improving the replenishing accuracy, it is effective to make the diameter of the solution feed tube to the replenishing nozzle narrow in order to prevent backflow at the time the pump is stopped. The inner diameter of the solution feed tube is preferably 1 to 8 mm, and 2 to 5 mm is especially preferable.

Although various types of materials for parts may be used in the automatic developing device which is the photosensitive material processing device of the present invention, the following materials are preferable.

In addition to the crystalline resins described previously, modified PPO (modified polyphenylene oxide) and modified PPE (modified polyphenylene ether) resin are preferable for use as the material of the processing tank. An example of the modified PPO is "Noryl" manufactured by Nippon GE Plastic Co., and examples of the modified PPE are "Xyron"

manufactured by Asahi Chemical Industry Co., Ltd. and "Iupiace" manufactured by Mitsubishi Gas Chemical Company, Inc. These materials have superior chemical resistance with respect to developing solutions, fixing solutions, bleaching/fixing solutions, and the like. These materials are appropriate for injection molding and are advantageous in that they can be used for low ratio expansion molding and various types of blow molding such as cinpres molding and gas counter pressure molding. Integral molding of guides or racks of the processing tanks is possible by using molding methods. Because these materials have a higher heat-resistant temperature than general ABS, the materials can be used for the material of the drying portion of the automatic developing device as well. When more heat-resistance and rigidity are needed, a glass-fiber-strengthened grade or a filler-added grade can be used.

Because ABS (acrylonitrile butadiene styrene resin) is chemical-resistant with respect to processing solutions (e.g., color developing solution, bleaching solution, fixing solution, bleaching/fixing solution), ABS can be used for portions of the tank or for the racks or the like. "Denka" manufactured by Denki Kagaku Kogyou Co., "Cycorack" manufactured by Ube Kosan Co., and ABS resins manufactured by various companies such as Mitsubishi Monsanto Kasei and Nippon Gosei Gomu can be used. It is preferable that ABS is used in an environment of less than or equal to 80° C. Further, ABS molds well by injection molding, and can be molded with good planarity and with few sink marks during molding. Therefore, ABS is a material which is suitable for the housing of the automatic developing device, and is suitable for the supply portions and the cassettes of the processor.

PE (polyethylene) and PP (polypropylene) which are olefin base resins have good chemical resistance with respect to processing solutions (e.g., color developing solution, bleaching solution, fixing solution, stabilizing solution). There are many types of manufactured PE, such as those manufactured by Showa Denko, Ube Kosan, and the like. There are many types of manufactured PP, such as those manufactured by Ube Kosan, Chisso, Mitsui Toatsu Kagaku, Asahi Chemical Industry Co., Ltd., and the like. PE and PP are used as materials for the replenishing tanks and the waste liquid tanks in the automatic processing device. Because these materials are inexpensive and can be used to easily make a large tank by blow molding, these materials are preferably used for regions which do not require high dimensional accuracy.

PVC (polyvinylchloride resin) has excellent chemical-resistance, is inexpensive, and has superior processability as it can be welded easily.

In addition to PVCs manufactured by Denki Kagaku Kogyo and Riken Vinyl Kogyo, many other companies such as mold manufacturers and the like manufacture various PVCs. Plate materials which are extrusion molded from Dakiron Kogyo's "Dakiron Plate" and Mitsubishi Jushi's "Hishi Plate" are sold. Further, various types of modified PVCs are sold and can be used easily. Tubular plastic "Kaiduc" and products from Sun Arrow Kagaku and the like are sold as acryl-modified PVCs. The surfaces of acryl-modified PVCs finish smoothly and are water-repellent. Acryl-modified PVCs are suitable materials for the tanks because it is difficult for processing solutions to precipitate thereon (e.g., precipitation of developing agents from a color developing solution). As a means of making the surface of a PVC extrusion-molded product or PVC injection-molded product smooth, in addition to the modified PVC, adding soybean oil or the like in order to improve the flowability during molding is very effective. The addition of soybean oil (particularly modified soybean oil) makes the resin surface smooth, does not deteriorate the quality of the photosensitive material by scratching or the like, and improves the flowability during molding.

Crystalline polymers can be used as the material for the processing tank and the processing portion guides in order to improve the conveyability of the photosensitive material and as a measure against the precipitation of color developer developing agents or the like. PET (polybutyleneterephthalate), HDPE (ultra high density polyethylene resin), PTFE (polytetrafluoroethylene resin), PFA (polytetrafluoroethylene perfluoroalkoxyethylene resin), PVDF (polyvinylidene fluoride resin) and the like are suitable for use as the material for the guides which the photosensitive material contacts and for the liquid surface portions at which it is easy for the processing solution (e.g., color developing solution) to precipitate. Effects are achieved even if the aforementioned fluorides are used as a coating for other materials such as PPE or the like.

Thermoplastic resins such as PVC (polyvinylchloride), PP (polypropylene), PE (polyethylene), UHMPE (ultra high molecular weight polyethylene), PMP (polymethylpentane), PPS (polyphenylene sulfide), modified PPO (modified polyphenylene oxide), modified PPE (modified polyphenylene ether), and the like are appropriate for use as the material of the rollers of the processing section.

Olefin base resins such as PP, PE, PMP and the like allow the roller surface to be injection molded smoothly, and allow the rotational load to be made small as the specific gravity thereof is low. Therefore, it is difficult for the emulsion surface of the photosensitive material being conveyed to be damaged, and these olefin base resins are suitable for use. Olefin base resins are often used for drum rollers of turn portions or the like. Materials such as UHMPE and PTFE (including PFA and PVDF) are suitable for portions at which the photosensitive material slides and portions at which processing solution repellence is required. Damage to the photosensitive material caused by precipitates of the processing solution adhering to and hardening at the rollers can be prevented. Rollers having these materials at the roller surfaces (including rollers which are coated with these materials) are suited for use as rollers positioned at the liquid surface of the processing solution or rollers at the squeeze portion.

PVC is easy to process into rollers by extrusion molding and is therefore suitable. Rollers having a soft resin portion at the surface thereof can be easily manufactured by double extrusion processing, and it is preferable that the photosensitive material is contacted by a soft touch. In addition to PVC, modified PPO, modified PPE, modified PPS and the like have high rigidity and can withstand high rotational torque, and therefore are suitable for use for rollers requiring conveying force. In order to further increase the rigidity of these materials, it is preferable to use fiberglass reinforcing or to use reinforced materials to which minerals such as mica, talc, titanium acid, potassium or the like have been added. By adding a reinforcing substance, the bending modulus of elasticity of the rollers improves, creep deformation due to changes over time can be prevented, the rollers do not bend due to long-term use, and a stable conveying performance can be ensured. By adding inorganic matter to the resin, the surface of the roller is made to have a slightly rough texture by the inorganic matter particles appearing on the surface of the roller, so that slippage of the photosensitive material being conveyed can be prevented. At this time, the roller surface roughness is controlled by adjusting the particle diameter and the added amount of the added inorganic matter.

Thermoset resins are suitable for conveying rollers whose diameters are small and conveying rollers whose lengths are long for photosensitive materials which are wide. For example, PF (phenol resin), thermoset urethane resin, and unsaturated polyester resin are preferable. Epoxy resins are suitable for certain processing solutions other than alkaline processing solutions. Resol base PFs are preferable, and "OR-85" manufactured by Mitsui Toatsu Kagaku is particularly suitable. Graphite may be added for reinforcement. Because these rollers can be made thin (e.g., an outer diameter of 8 mm), the processing rack can be made compact. Nippon Unipolymer's "Uniron", Dainippon Inki Kagaku Kogyo's "Pandex", Takeda Yakuhin Kogyo's "Takenate" and the like are suitable for the thermoset urethane resin.

Rollers covered with a fluorine base resin film are preferable from the standpoint of preventing staining caused by the developing solution. More specifically, the resins disclosed in Japanese Patent Application Laid-Open (JP-A) No. 4-161955 or the like may be used.

Elastomers may be used at soft rollers such as nip rollers. For example, olefin base elastomers, styrene base elastomers, urethane base elastomers, PVC elastomers and the like are preferable.

The following thermoplastic crystalline resins are suited for the gears and sprockets of the processing portion: PA (polyamide), PBT (polybutylene terephthalate), UHMPE (ultra high molecular weight polyethylene), PPS (polyphenylsulfide), LCP (aromatic polyester resins, liquid crystal polymers), PEEK (polyether etherketone), and the like.

PA includes, in addition to polyamide resins such as 66 nylon, 6 nylon, 12 nylon and the like, modified polyamides and aromatic polyamides having an aromatic ring in the molecular chain. Examples of the 66 nylon and the 6 nylon are "Zytel" by Toray and Dupont, and examples of the 12 nylon are "Rirusan" by Toray and "Diamide" by Dycell Hurus. Mitsubishi Gas Chemical Company Inc.'s "Reni" polyamide MXD6 is suitable for the aromatic polyamide, and Mitsui Petrochemical Industries Ltd.'s "Allene" modified polyamide 6T is suitable for the modified polyamide. It is preferable that the PA is a fiberglass reinforced or carbon fiber reinforced grade because PAs swell easily in the processing solution because the absorption ratio thereof is high. Because aromatic polyamides have a relatively low absorption ratio, it is difficult for aromatic polyamides to swell, and high dimensional accuracy can be obtained. High molecular weight articles such as MC nylon obtained by compression molding exhibit sufficient performances even if not fiber reinforced. Oil-containing nylon resins such as "polyslider" can also be used.

In contrast to PA, PBT has an extremely low absorption ratio, and therefore, has good chemical resistance to processing solutions. PBTs manufactured by Toray and Dainippon Inki Kagaku Kogyo as well as "Barox" manufactured by Nippon GE Plastics can be used. Fiberglass reinforced PBTs and unreinforced PBTs are used in accordance with the region. In order to improve the meshing of gears, it is preferable to use a fiberglass reinforced PBT in combination with an unreinforced PBT.

Unreinforced UHMPEs are suitable. Examples of suitable UHMPEs are "Ryubuma" and "Hi-Zex Million" by Mitsui Petrochemical Industries Ltd., "Newlight" by Saxin Corporation, "Sunfine" by Asahi Chemical Industry Co., Ltd., and "ultra high molecular weight polyethylene UHMW" by Dainippon Insatsu. Fiberglass reinforced and carbon fiber reinforced PPSs are preferable. Examples of the LCP are "Victrex" by ICI Japan, "Ekonol" by Sumitomo Chemical Co., Ltd., "Xydar" by Amoco Performance Products Inc., "Vectra" by Polyplastics, and the like. PEEK has extremely good chemical resistance and durability with respect to all of the processing solutions of the developing device, and is an ideal material which exhibits sufficient effects as an unreinforced material.

It is preferable to use EPDM rubber, silicon rubber, fluororubbers, olefin base elastomers, styrene base elastomers, urethane base elastomers, PVC base elastomers and the like for the rubber material and the elastomers used for the piping, the joints of the piping, the joints of the agitation jet pipes, the seal members and the like.

Specific examples include "Sumiflex" manufactured by Sumitomo Bakelight Co., Ltd., "Milastomer" (an olefin base elastomer) manufactured by Mitsui Petrochemical Industries Ltd., "Samoran" (an olefin base elastomer containing rubber) and "Labaron" manufactured by Mitsubishi Yuka Co., Ltd., "Santoplane" manufactured by Nippon Monsanto Kasei Co., Ltd. or AIS Japan Co., Ltd., "Sanplane" manufactured by Mitsubishi Kasei Vinyl Co., Ltd., silicon rubbers and Viton rubbers disclosed in Japanese Patent Application Laid-Open (JP-A) No. 3-198052, and the like.

The material s such as plastics used in the processing tanks and other portions of the processing device described above can be easily selected and obtained on the basis of "Plastic Molding Materials Business Transactions Handbook—Characteristic Database, 1991 Edition" published by Synthetic Resin Industries Newspaper Co., Ltd. (Gosei Jushi Kogyo Shinbunsha).

As described above, the photosensitive material processing device relating to the present invention has superior effects in that the amounts of processing solutions within the processing tanks can be decreased, and the temperatures of the processing solutions in the processing tanks, which are made to contain smaller amounts of processing solutions, can be maintained constant.

What is claimed is:

1. A photosensitive material processing device comprising:

a processing tank in which is stored a processing solution for processing photosensitive materials;

wherein the processing tank is formed such that, given that a tank volume of the processing tank is V milliliters and a path length which is a conveying distance from a position at which a photosensitive material begins to contact the processing solution within the processing tank to a position at which the photosensitive material is discharged from the processing solution is L centimeters, a value V/L is less than or equal to 25;

a circulating path which circulates the processing solution within the processing tank; and a cast heater disposed on the circulating path, which heats the processing solution in the circulating path to a predetermined temperature.

2. A photosensitive material processing device according to claim 1, wherein the processing tank is a developing tank which stores developing solution as the processing solution.

3. A photosensitive material processing device according to claim 1, wherein the processing tank is a bleaching/fixing tank which stores bleaching/fixing solution as the processing solution.

4. A photosensitive material processing device according to claim 1, wherein the processing tank is a stabilizing tank which stores a stabilizer as the processing solution.

5. A photosensitive material processing device according to claim 1, wherein the circulating path is disposed so as to send the processing solution from a central portion of the processing tank to an introduction side portion of the processing tank, into which the photosensitive material is introduced, and to a discharge side portion of the processing tank, from which the photosensitive material is discharged.

6. A photosensitive material processing device according to claim 1, wherein the processing tank is formed in a U-shape, and the circulating path is disposed so as to send the processing solution from a central portion of the processing tank to an introduction side portion of the processing tank, into which the photosensitive material is introduced, and to a discharge side portion of the processing tank, from which the photosensitive material is discharged.

7. A photosensitive material processing device according to claim 1, wherein the processing tank is formed in a U-shape, and the circulating path is disposed so as to connect a central portion of the processing tank with an introduction side portion of the processing tank, in which the photosensitive material is introduced, and with a discharge side portion of the processing tank, from which the photosensitive material is discharged, and further comprising:

a pump disposed on the circulating path, which sends processing solution from the central portion of the processing tank to the introduction side portion and the discharge side portion of the processing tank.

8. A photosensitive material processing device according to claim 1, wherein the cast heater is formed by casting a heater and a piping having good thermal conductivity in a metal having good thermal conductivity.

9. A photosensitive material processing device according to claim 1, wherein the photosensitive material is a negative film, and the negative film is processed in the processing solution.

10. A photosensitive material processing device comprising:

a processing tank in which is stored a processing solution for processing photosensitive materials;

wherein the processing tank is formed such that, given that a tank volume of the processing tank is V milliliters and a path length which is a conveying distance from a position at which a photosensitive material begins to contact the processing solution within the processing tank to a position at which the photosensitive material is discharged from the processing solution is L centimeters, a value V/L is less than or equal to 25;

a circulating path which circulates the processing solution within the processing tank;

a replenishing path which replenishes replenishing solution to the processing tank; and a cast heater provided on the circulating path and the replenishing path, which heats the processing solution in the circulating path and the replenishing solution in the replenishing path to a predetermined temperature.

11. A photosensitive material processing device according to claim 10, wherein one end of the replenishing path is connected to the circulating path, and a replenishing tank which stores replenishing solution is provided at another end of the replenishing path.

12. A photosensitive material processing device according to claim 10, wherein one end of the replenishing path is connected to the circulating path, and further comprising a replenishing tank which stores replenishing solution is provided at another end of the replenishing path, and a replenishing pump which sends replenishing solution within the replenishing tank into the circulating path is provided on the replenishing path.

13. A photosensitive material processing device according to claim 10, wherein the cast heater is formed such that a pair of pipings, which have good thermal conductivity and form a portion of the circulating path and the replenishing path respectively, and a heater are cast in a metal having good thermal conductivity.

14. A photosensitive material processing device comprising a processing tank in which is stored a processing solution for processing photosensitive materials;

wherein the processing tank is formed such that, given that a tank volume of the processing tank is V milliliters and a path length which is a conveying distance from a position at which a photosensitive material begins to contact the processing solution within the processing tank to a position at which the photosensitive material is discharged from the processing solution is L centimeters, a value V/L is less than or equal to 25;

a circulating path which circulates the processing solution within the processing tank, and a cast heater which heats the processing solution in the circulating path to a predetermined temperature is mounted to the processing tank.

15. A photosensitive material processing device according to claim 14, wherein the cast heater is mounted to the processing tank so as to be attachable thereto and removable therefrom.

16. A photosensitive material processing device according to claim 14, wherein the processing tank is formed by an insertion portion into which the photosensitive material is inserted and a main body portion which is continuous with the insertion portion, and the cast heater is disposed at the insertion portion, and the insertion portion is fit with and connected to the main body portion and is fixed by a fixing member.

17. A photosensitive material processing device according to claim 14, wherein a position at which the cast heater is mounted to the processing tank is lower than a liquid surface of the processing solution stored within the processing tank.

18. A photosensitive material processing device comprising:

a processing tank in which is stored a processing solution for processing photosensitive materials;

wherein the processing tank is formed such that, given that a tank volume of the processing tank is V milliliters and a path length which is a conveying distance from a position at which a photosensitive material begins to contact the processing solution within the processing tank to a position at which the photosensitive material is discharged from the processing solution is L centimeters, a value V/L is less than or equal to 25; and wherein the processing tank is formed of a crystalline resin;

a circulating path which circulates the processing solution within the processing tank; and a cast heater disposed on the circulating path, which heats the processing solution in the circulating path to a predetermined temperature.

19. A photosensitive material processing device comprising:

a processing tank in which is stored a processing solution for processing photosensitive materials;

wherein the processing tank is formed such that, given that a tank volume of the processing tank is V milliliters and a path length which is a conveying distance from a position at which a photosensitive material begins to contact the processing solution within the processing tank to a position at which the photosensitive material is discharged from the processing solution is L centimeters, a value V/L is less than or equal to 25; and wherein the processing tank is formed such that pairs of conveying rollers which nip and convey the photosensitive material are disposed at an inner side of the processing tank and pairs of transmission rollers which transmit drive force to the conveying rollers are disposed at an outer side of the processing tank, and the drive force from the pairs of transmission rollers is transmitted by magnetism to the pairs of conveying rollers so as to rotate the pairs of conveying rollers; and a circulating path which circulates the processing solution within the processing tank; and a cast heater disposed on the circulating path, which heats the processing solution in the circulating path to a predetermined temperature.

20. A photosensitive material processing device comprising:

a processing tank in which is stored a processing solution for processing photosensitive materials;

wherein the processing tank is formed such that, given that a tank volume of the processing tank is V milliliters and a path length which is a conveying distance from a position at which a photosensitive material begins to contact the processing solution within the processing tank to a position at which the photosensitive material is discharged from the processing solution is L centimeters, a value V/L is less than or equal to 25;

a circulating path which circulates the processing solution within the processing tank; and a cast heater which heats the processing solution in the circulating path to a predetermined temperature is mounted to the processing tank;

wherein the processing tank is formed by two metal plates having good thermal conductivity and good corrosion-resistance being press molded and welded, and the cast heater is cast and formed integrally with the processing tank.

* * * * *